US005540064A

United States Patent [19]

Matsuda et al.

[11] Patent Number: 5,540,064

[45] Date of Patent: Jul. 30, 1996

[54] KNIT SLIDE FASTENER

[75] Inventors: Yoshio Matsuda; Shunji Akashi; Hidenobu Kato; Yoshito Ikeguchi, all of Toyama-ken, Japan

[73] Assignee: YKK Corporation, Tokyo, Japan

[21] Appl. No.: 492,993

[22] Filed: Jun. 21, 1995

[30] Foreign Application Priority Data

| | | | |
|---|---|---|---|
| Jun. 23, 1994 | [JP] | Japan | 6-174669 |
| Sep. 28, 1994 | [JP] | Japan | 6-270133 |
| Dec. 28, 1994 | [JP] | Japan | 6-340937 |
| Mar. 29, 1995 | [JP] | Japan | 7-107738 |

[51] Int. Cl.[6] ..... D04B 21/20; D04B 21/14; A44B 19/56

[52] U.S. Cl. ..... 66/193; 66/190; 66/192; 66/195; 24/392

[58] Field of Search ..... 66/190, 192, 193, 66/194, 195; 24/391, 392, 393, 397, 398

[56] References Cited

U.S. PATENT DOCUMENTS

| | | | |
|---|---|---|---|
| 3,996,773 | 12/1976 | Hatsuda | 66/195 X |
| 4,051,579 | 10/1977 | Heimberger | 66/195 X |
| 4,075,874 | 2/1978 | Heimberger | 66/190 X |
| 4,135,555 | 1/1979 | Mausbach | 24/392 X |
| 4,137,733 | 2/1979 | Heimberger | 66/195 |
| 4,467,840 | 8/1984 | Tsubata | 24/392 X |

FOREIGN PATENT DOCUMENTS

| | | | |
|---|---|---|---|
| 2179222 | 11/1973 | France | 24/392 |
| 2114700 | 10/1972 | Germany | 66/193 |
| 2093873 | 9/1982 | United Kingdom | 66/193 |

*Primary Examiner*—John J. Calvert
*Attorney, Agent, or Firm*—Hill, Steadman & Simpson

[57] ABSTRACT

A knit slide fastener including a fastener tape composed of a warp-knit ground structure and having an element-supporting portion along one longitudinal edge thereof, and a row of continuous coupling elements knit into and along the element-supporting portion as the fastener tape is knit, wherein two threads are knit as binding chain stitches of a double-knit structure into the element-supporting portion, each of the binding chain-stitch threads having a series off upper needle loops binding legs of the row of continuous coupling elements, and a series of lower needle loops intertwined with needle loops of corresponding chain-stitch threads forming a part of the ground structure. With this arrangement, the element-supporting portion is made tight and has a fine knit structure which will insure attachment of the of coupling elements to the element-supporting portion with high dimensional stability.

5 Claims, 23 Drawing Sheets

KNIT SLIDE FASTENER

BACKGROUND OF THE INVENTION

1. Field of the Invention

The present invention relates to a knit slide fastener having a row of continuous coupling elements knit into and along an element-supporting portion of one longitudinal edge of a knit fastener tape as the fastener tape is knit.

2. Description of the Prior Art

A conventional knit slide fastener disclosed, for example, in Japanese Patent Publication No. 38-11673 includes a fastener tape knit with threads of chain stitches and laid-in weft threads and having a longitudinal edge portion into and along which a nylon wire is laid to form a row of continuous coupling elements knit into the chain stitches as the fastener tape is knit. Another known knit slide fastener disclosed U.S. Pat. No. 5,035,125 includes a fastener knit with threads of chain stitches and a laid-in weft thread, and a row of continuous coupling elements formed from a plastic monofilament laid in and along one longitudinal edge portion of the fastener tape. At the longitudinal tape edge portion, the laid-in weft thread is interlaced with the chain stitches of two adjacent wales to urge the upper legs of the coupling elements downwards, and also with the chain stitches of a neighboring wale to urge the lower legs of the coupling elements downwards.

The conventional knit slide fasteners previously described are of the type including a fastener tape knit with threads of chain stitches and laid-in weft threads, and a plastic monofilament laid into one longitudinal edge portion of the fastener tape to form a row of continuous coupling elements knit into and along the one longitudinal tape edge portion. In the first-mentioned knit slide fastener, since the row of continuous coupling elements is restrained or bound by sinker loops of the chain-stitch threads of the ground structure, due to longitudinal stretch and contraction of the chain stitches, a desired dimensional stability is difficult to obtain. Because of this dimensional in stability, a smooth coupling engagement between two opposed rows of coupling elements is difficult to achieve. In the second-mentioned knit slide fastener, since needle loops of the chain-stitch threads are merely interlaced with the laid-in weft thread extending transversely across the longitudinal tape edge portion, wales composed of the chain stitches used to restrain or bind the legs of the coupling elements are readily stretchable in the longitudinal direction. Accordingly, like the first-mentioned knit slide fastener, the second-mentioned knit slide fastener is also dimensionally instable and cannot insure smooth coupling engagement between two opposed rows of coupling elements.

SUMMARY OF THE INVENTION

With the foregoing drawbacks of the prior art in view, it is an object of the present invention to provide a knit slide fastener having a row of continuous coupling elements firmly secured to one longitudinal edge portion of a fastener tape with high dimensional stability to insure smooth coupling engagement between two opposed rows of the continuous coupling elements.

To attain the forgoing object, the present invention provides in one aspect a knit slide fastener including a fastener tape composed of a warp-knit ground structure and having element-supporting portion along one longitudinal edge thereof, and a row of continuous coupling elements knit into and along the element-supporting portion as the fastener tape is knit, each of the coupling elements having a pair of legs, wherein the improvement comprises: a thread knit as binding chain stitches of a double-knit structure into the element-supporting portion, the binding chain-stitch thread having a series of longitudinally disposed upper needle loops binding the legs of the row of continuous coupling elements, and a series of longitudinally disposed lower needle loops intertwined with knitting threads of the warp-knit ground structure at the element-supporting portion.

The knit slide fastener may further include a thread knit as binding tricot stitches of a double-knit structure into the element-supporting portion together with the binding chain-stitch thread. The tricot-stitch thread has a series of longitudinally disposed upper needle loops binding the legs of the row of continuous coupling elements and intertwined with the upper needle loops of the binding chain-stitch thread, and a series of longitudinally disposed lower needle loops intertwined with the knitting thread of the warp-knit ground structure at the element-supporting portion.

As an alternative, the knit slide fastener may further include a thread knit as binding two-needle stitches of a double-knit structure into the element-supporting portion together with the binding chain-stitch thread. The two-needle-stitch thread has a series of longitudinally disposed upper needle loops binding the legs of the row of continuous coupling elements and intertwined with the upper needle loops of the binding chain-stitch thread.

In another aspect the invention provides a knit slide fastener including a fastener tape composed of a warp-knit ground structure and having an element-supporting portion along one longitudinal edge thereof, and a row of continuous coupling elements knit into and along the element-supporting portion as the fastener tape is knit, each of the coupling elements having a pair of legs, wherein the improvement comprises: at least two parallel juxtaposed threads knit as binding chain stitches of a double-knit structure into the element-supporting portion, and each of the binding chain-stitch threads has a series of upper needle loops intertwined with needle loops of a thread knit as tricot stitches extending on and along an upper surface of the row of continuous coupling elements, and a series of lower needle loops intertwined with needle loops of a thread knit as tricot stitches forming a part of the warp-knit ground structure at the element-supporting portion. The row of continuous coupling elements is secured by the binding chain-stitch threads to the element-supporting portion, with the legs restrained between the tricot stitches overlying the row of coupling elements and the tricot stitches underlying the row of coupling elements.

The present invention provides in still another aspect a knit slide fastener including a fastener tape composed of a warp-knit ground structure and having an element-supporting portion along one longitudinal edge thereof, and a row of continuous coupling elements knit into and along the element-supporting portion as the fastener tape is knit, each of the coupling elements having a pair of legs, wherein the improvement comprises: at least two parallel juxtaposed threads knit as binding chain stitches of a double-knit structure into the element-supporting portion, and each of the binding chain-stitch threads has a series of upper needle loops intertwined with needle loops of a thread knit as two-needle stitches extending on and along an upper surface of the row of continuous coupling elements, and a series of lower needle loops intertwined with needle loops of a thread knit as two-needle stitches forming a part of the warp-knit ground structure at the element-supporting portion. The row of continuous coupling elements is secured by the binding chain-stitch threads to the element-supporting portion, with the legs restrained between the two-needle stitches overlying the row of continuous coupling elements and the two-needle stitches underlying the row of continuous coupling elements.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
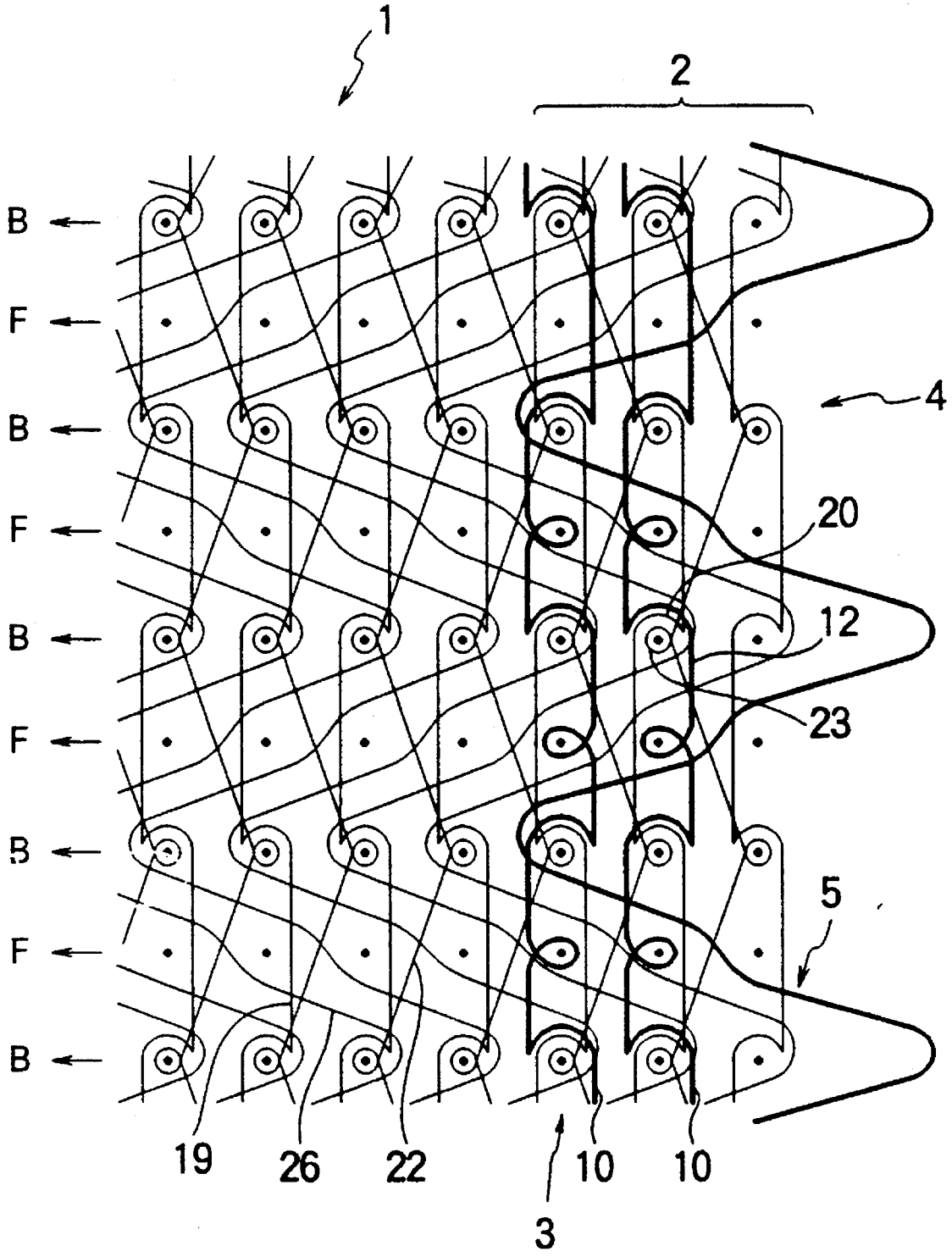
FIG. 1 is a point diagram of a knit slide fastener according to a first embodiment of the present invention.

Certain preferred embodiments of the present invention will be described below in greater detail with reference to the accompanying drawings. Referring now to FIG. 1, there is shown a point diagram of a knit slide fastener according to a first embodiment of the present invention.

Figures 2A, 2B, 2C, 2D:
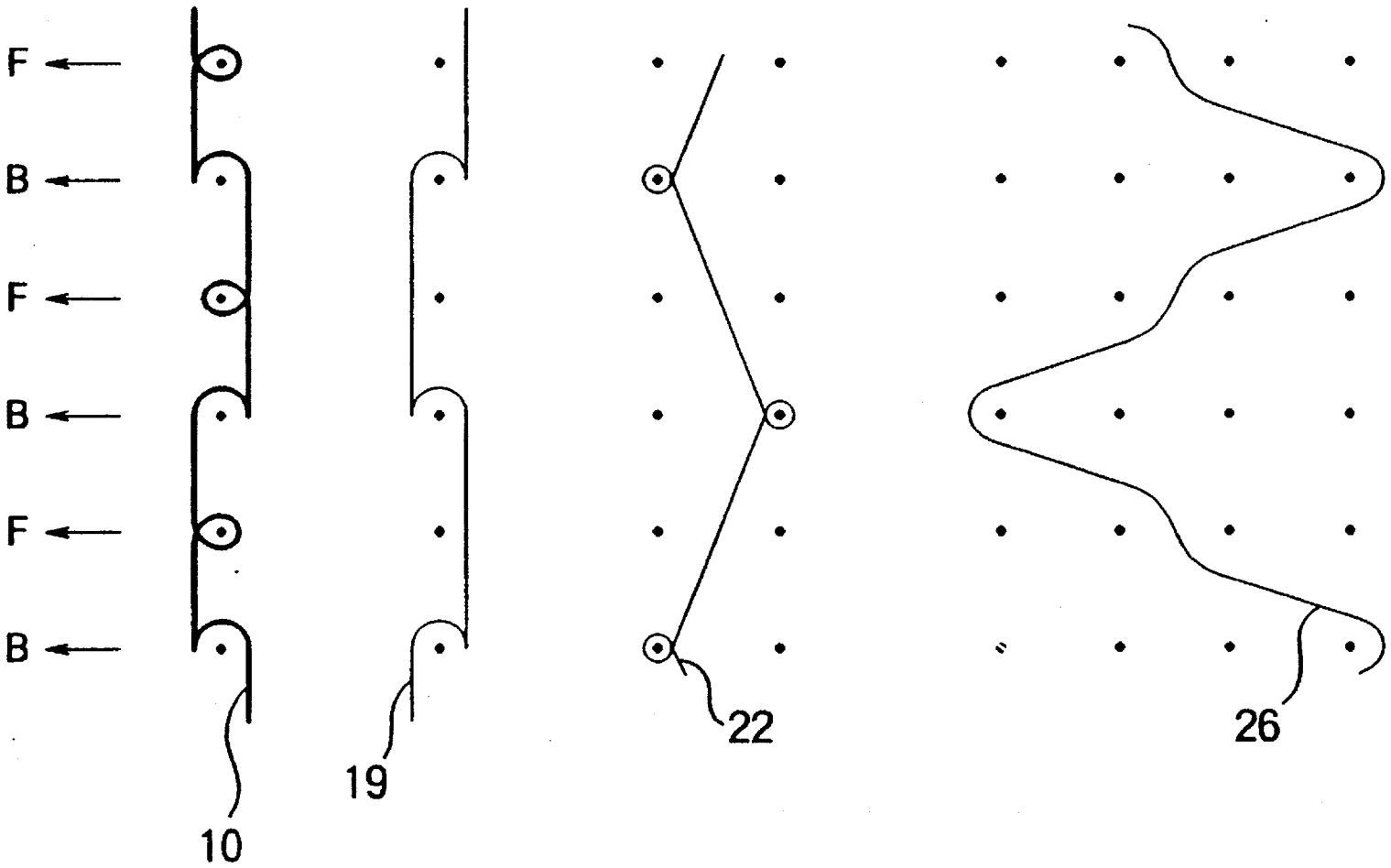
FIGS. 2(A)–2(D) are point diagrams showing knitting patterns of various threads of FIG. 1.
Figure 3:
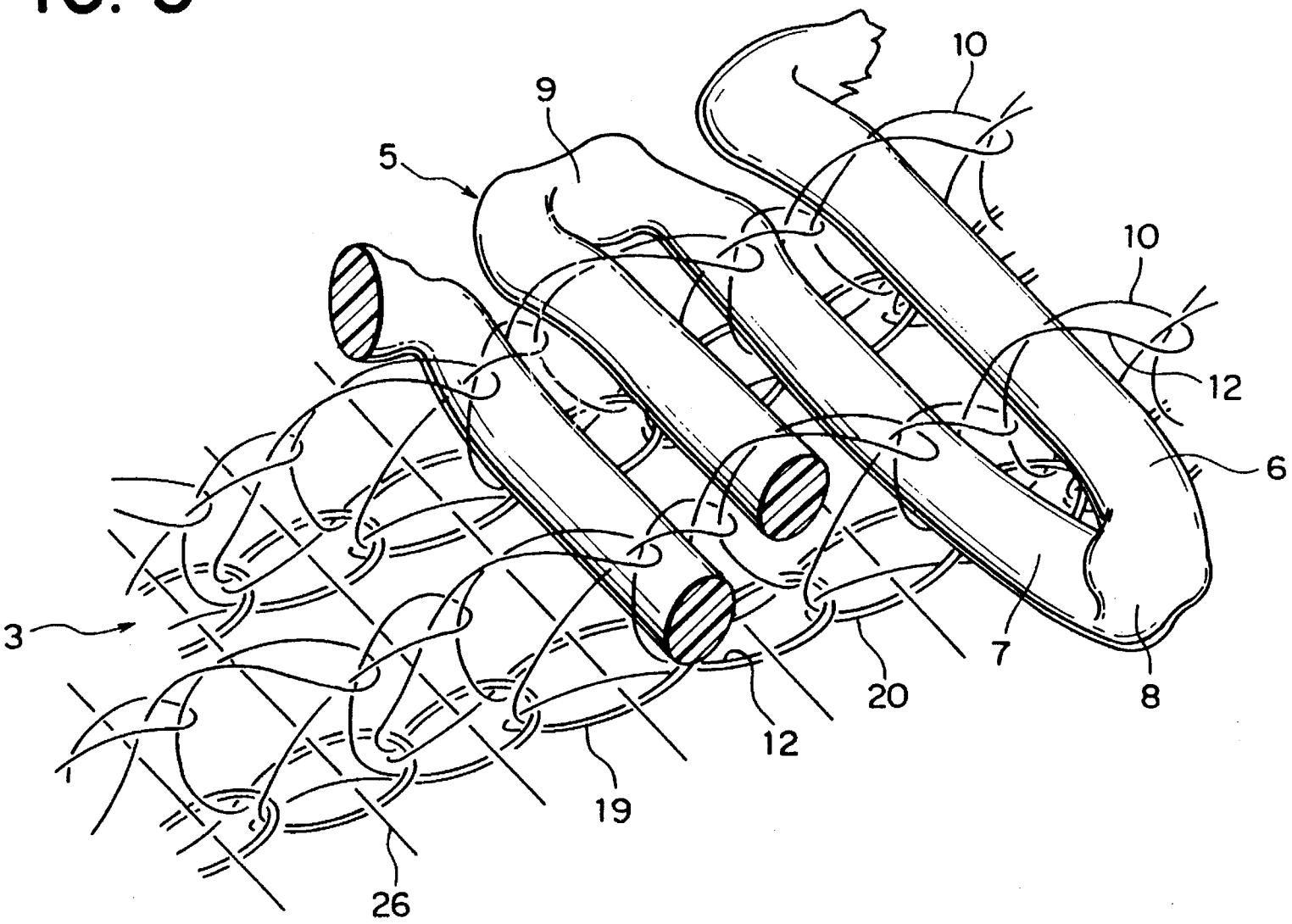
FIG. 3 is a diagrammatical perspective view of an essential portion of the slide fastener of FIG. 1, showing the manner in which a row of coupling elements is attached.
Figure 4:
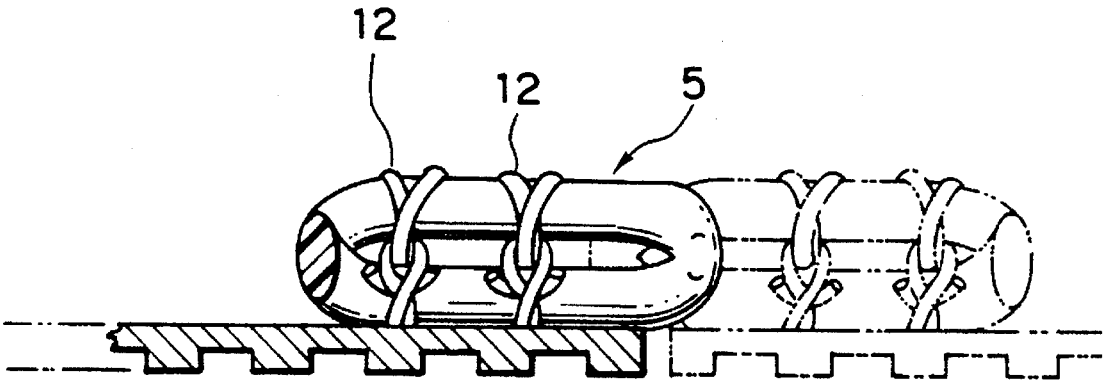
FIG. 4 is a transverse cross-sectional view of the slide fastener of FIG. 3.

The knit slide fastener (hereinafter simply referred to as "fastener") is knit on a warp-knitting machine of the general type having a double needle bed (double Raschel loom, for example). The fastener includes a fastener tape 1 having a warp-knit ground structure composed of a plurality of threads 19 knit as chain stitches having a pattern of 1-0/0-0/0-1/1-1, as shown in FIG. 2(B), a plurality of threads 22 knit as tricot stitches having a pattern of 1-2/1-1/1-0/1-1, as shown in FIG. 2(C), and a plurality of laid-in weft threads 26 laid in a zigzag pattern of 0-0/2-2/4-4/2-2, as shown in FIG. 2(D). Each of the laid-in weft threads extends across four adjacent wales 3. Three adjacent ones of the wales 3, which extend along one longitudinal edge of the fastener tape 1, form an element-supporting portion 2 to which a row of continuous helically coiled coupling elements 5 is attached by knitting as the fastener tape 1 is knit. The row of coiled coupling elements 5 is formed from a monofilament of synthetic resin, such as nylon or polyester. In forming the coiled coupling elements 5, the synthetic resin monofilament is reciprocated transversely of the fastener tape 1 while changing courses 4 in which the monofilament is laid. As shown in FIG. 3, the row of coiled coupling elements 5 thus attached have upper and lower legs 6 and 7 restrained or bound by two threads 10 knit as binding chain stitches having a pattern of 0-1/1-0/1-0/0-1, as shown in FIG. 2(A), and extending along second and third outermost wales 3 of the longitudinal edge portion of the fastener tape 1.

In the point diagram shown in FIG. 1, the needle position of front needles and the needle position of back needles are designated by F and B, respectively. The front needles F and the back needles B are arranged in alternate courses 4. On the front needles F, knitting threads each form one needle loop overlying the upper surface of the row of coiled coupling elements 5 being knit in the fastener tape 1. In the illustrated embodiment, the binding chain-stitch threads 10 knit as a double-knit structure has a series of needle loops 12 on its one or upper side. Each of the needle loops 12 is interlocked with the succeeding needle loop 12 of the same binding chain-stitch thread 10. By repeating this knitting procedure, a series of chain stitches are formed longitudinally on and along the row of coiled coupling elements 5. On the back needles B, a tape portion of the fastener tape 1 and a part of the element-supporting portion adapted to support the row of coupling elements 5 at one longitudinal tape edge are knit. In the illustrated embodiment, the chain-stitch threads 19, the tricot-stitch threads 22 and the laid-in weft threads 26 are knit together to form the fastener tape 1, and at the same time, the binding chain-stitch threads 10 each form a series of needle loops 12 on the opposite or lower side. The lower needle loops 12 are intertwined with needle loops 20 of the chain-stitch threads 19 forming a part of the ground structure of the fastener tape 1.

Figure 5:
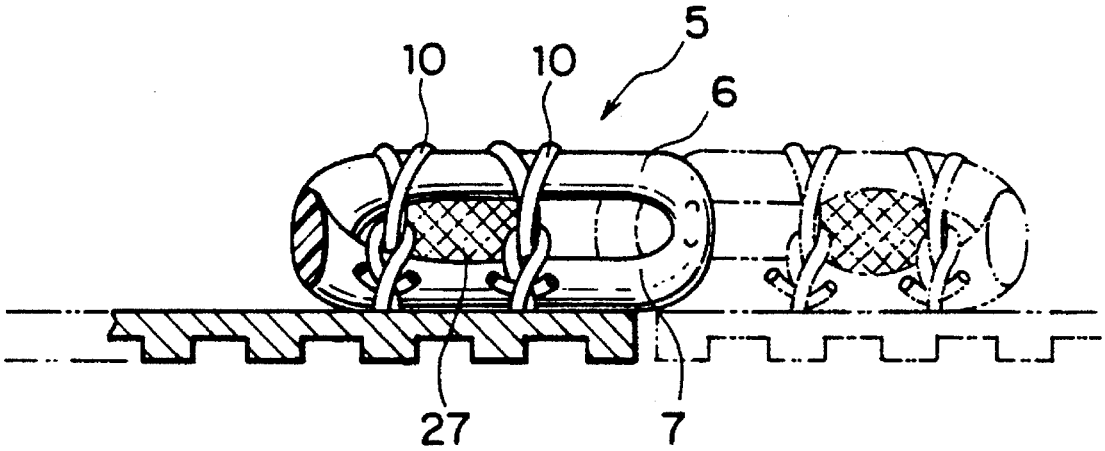
FIG. 5 is a view similar to FIG. 4, but showing a modified slide fastener including a core cord inserted between opposed legs of the coupling elements.

As shown in FIGS. 1 and 3 (in FIG. 3, for purposes of illustration, the tricot-stitch threads 22 are omitted, the laid-in weft threads 26 are each illustrated by a single solid line, and each of the knitting threads is shown as being composed of a thin thread and as being knit to form loose stitches), the binding chain-stitch threads 10 of the first embodiment each have needle loops 12 intertwined with the needle loops 20 of a corresponding one of the chain-stitch threads 19 and needle loops 23 of the tricot-stitch threads 22 (FIG. 1) of the ground structure. Thus, the upper and lower legs 6 and 7 of each coupling element 5 are restrained or bound by stitches formed by the needle loops of the binding chain-stitch threads 10. In this embodiment, since the monofilament reciprocates changing the courses 4 as described above, sinker loops of the binding chain-stitch threads 10 pass between the upper and lower legs 6 and 7 of the respective coupling elements 5, as shown in FIG. 3. Accordingly, the row of coupling elements 5 is secured, with the upper and lower legs 6 and 7 of each coupling element 5 restrained or bound separately. The row of coiled coupling elements 5 thus attached are protected against lateral displacement and hence is able to improve the function as a fastener. As a preferred modification, a core cord 27 may be inserted between the upper and lower legs 6 and 7 throughout the length of the row of coiled coupling elements 5, as shown in FIG. 5. The core cord 27 is disposed centrally between the two binding chain-stitch threads 10, 10. The binding chain-stitch threads 10 knit as a double-knit structure may be composed of threads which are thicker and have a greater heat-shrinkability than the knitting threads used for forming the fastener tape 1. When a finished fastener is subjected to a heat-setting process, the thick and highly heat-shrinkable binding chain-stitch threads 10 are thermally shrunk and bind the coupling elements more tightly than before, thereby insuring firm attachment of the row of coupling elements 5 with improved dimensional stability.

The synthetic resin monofilament used for forming a row of coiled coupling elements 5 is previously flattened by stamping at portions to be coupling heads 8 and connecting portions 9 of the coupling elements 5. The monofilament having such flattened portions is supplied between the front and back needles F and B and reciprocated transversely across the element-supporting portion 2 of a fastener tape 1 being knit during which time it is bent at each of the flattened portions. Thus, the monofilament is shaped into a row of coiled coupling elements 5 each having a coupling head 8, a pair of upper and lower legs 6, 7 extending from the coupling head 8 in a common direction, and a connecting portion 9 opposite to the coupling head 8 and interconnecting the upper leg 6 of one coupling element 5 and the lower leg 7 of the adjacent coupling element 5. The aforesaid stamping may be omitted when the monofilament has a rectangular or an elliptical cross section. The monofilament having such cross-sectional shape is laid-in without stamping and directly shaped into a row of coiled coupling elements.

Figure 6:
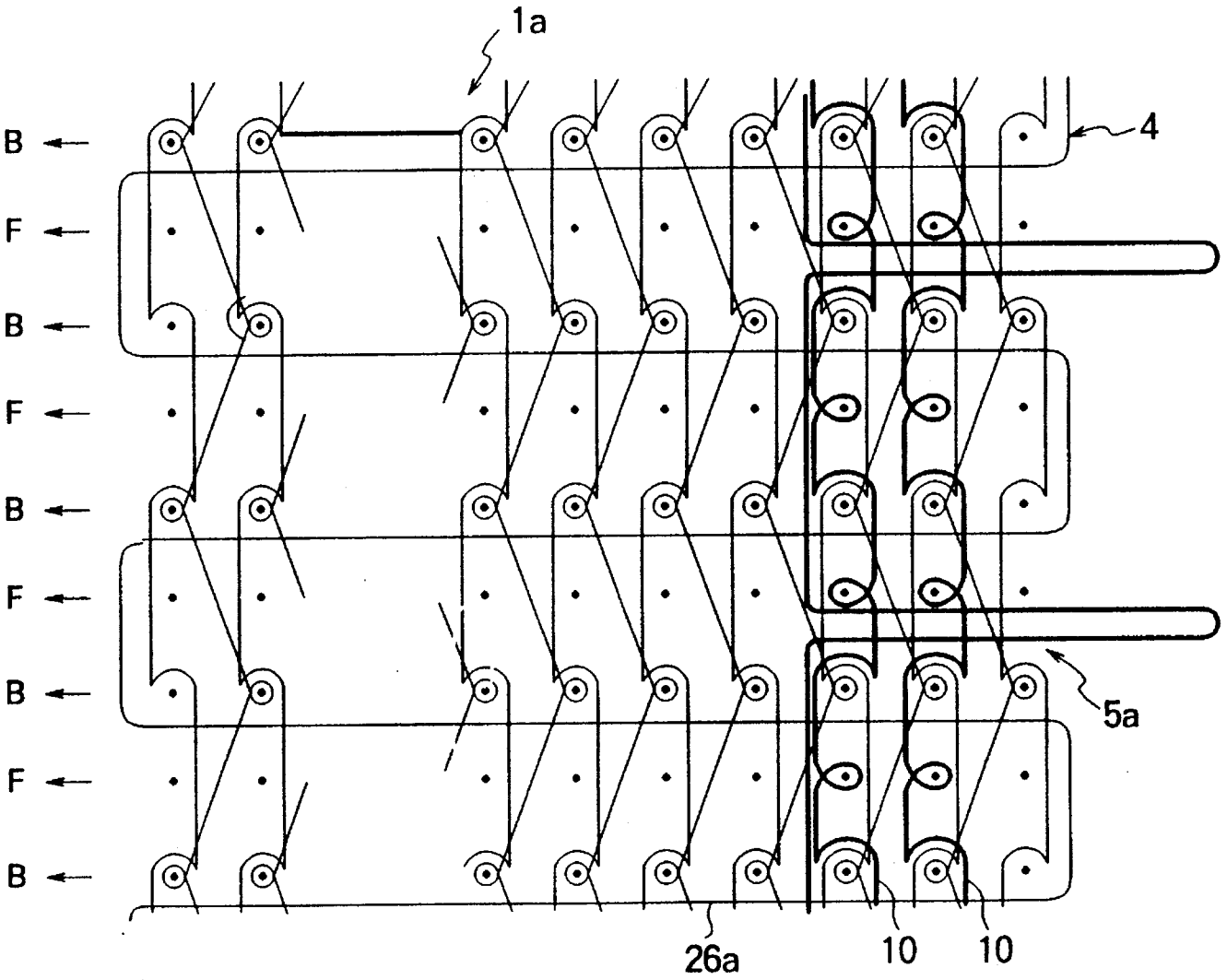
FIG. 6 is a point diagram of a knit slide fastener according to a second embodiment of the present invention.
Figure 7:
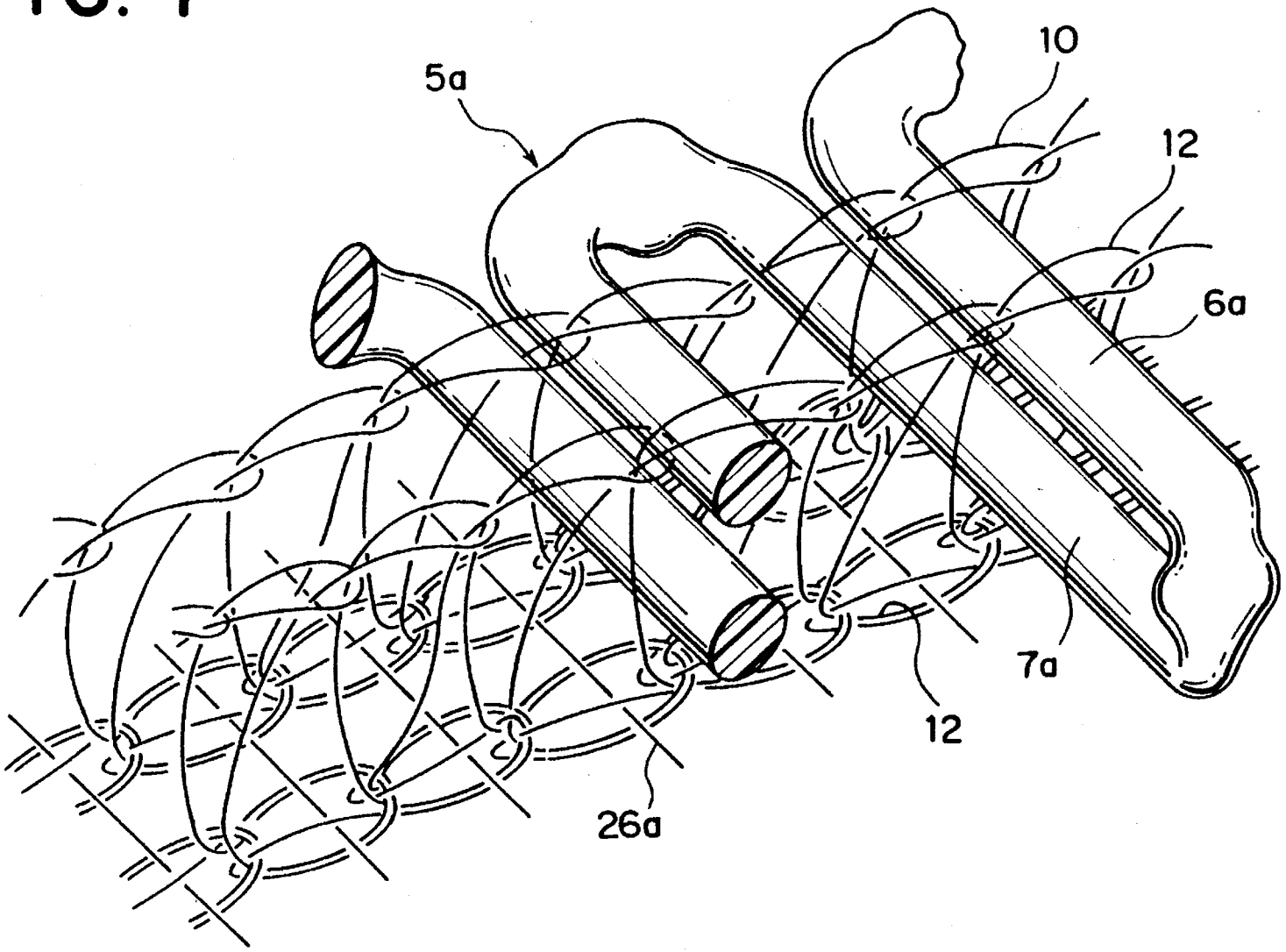
FIG. 7 is a diagrammatical perspective view of an essential portion of the slide fastener of FIG. 6, showing the manner in which a row of coupling elements is attached.
Figure 8:
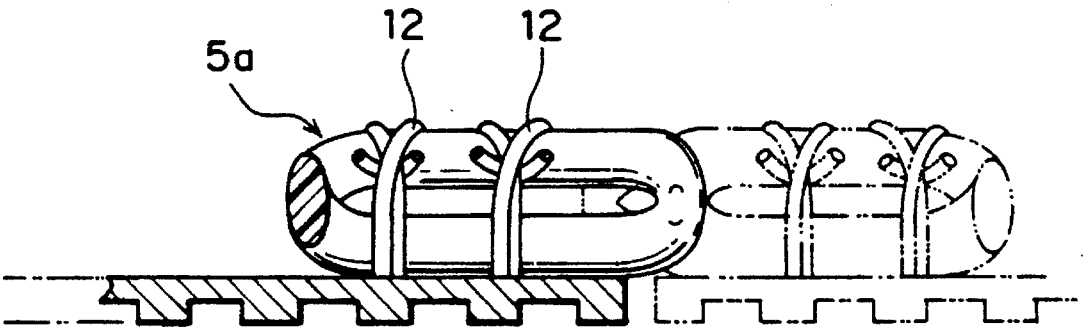
FIG. 8 is a transverse cross-sectional view of the slide fastener of FIG. 7.
Figure 9:
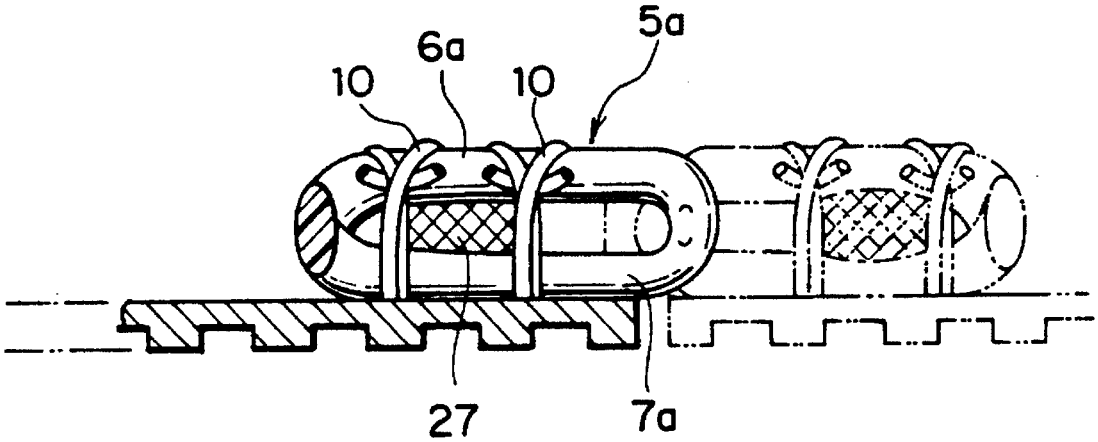
FIG. 9 is a view similar to FIG. 8, but showing a modified slide fastener including a core cord inserted between opposed legs of the coupling elements.

FIG. 6 shows a fastener according to a second embodiment of the present invention which is differentiated from the fastener of the first embodiment of FIG. 1 by a laid-in weft thread **26*a* and a row of coiled coupling elements 5*a*. The laid-in weft thread 26*a* is laid in a zigzag pattern across the entire width of a fastener tape 1*a*. The coiled coupling elements 5*a* each have an upper leg 6*a* and a lower leg 7*a* laid in the same course 4 and hence aligned vertically with each other. As shown in FIGS. 7 and 8 (in FIG. 7, tricot-stitch threads are omitted for purposes of illustration), the vertically aligned or superposed upper and lower legs 6*a*, 7*a* are restrained or bound from the above by the needle loops 12 of two binding chain-stitch threads 10 having a double-knit structure. The row of coiled coupling elements 5*a* is shaped from a synthetic resin monofilament which is supplied between the front and back needles F and B and then reciprocated in the same course 4 transversely across one longitudinal tape edge. The fastener of this embodiment may further include a core cord 27 which, as shown in FIG. 9, is inserted between the upper and lower legs 6*a*, 7*a* throughout the length of the row of coiled coupling elements 5*a***.

Figure 10:
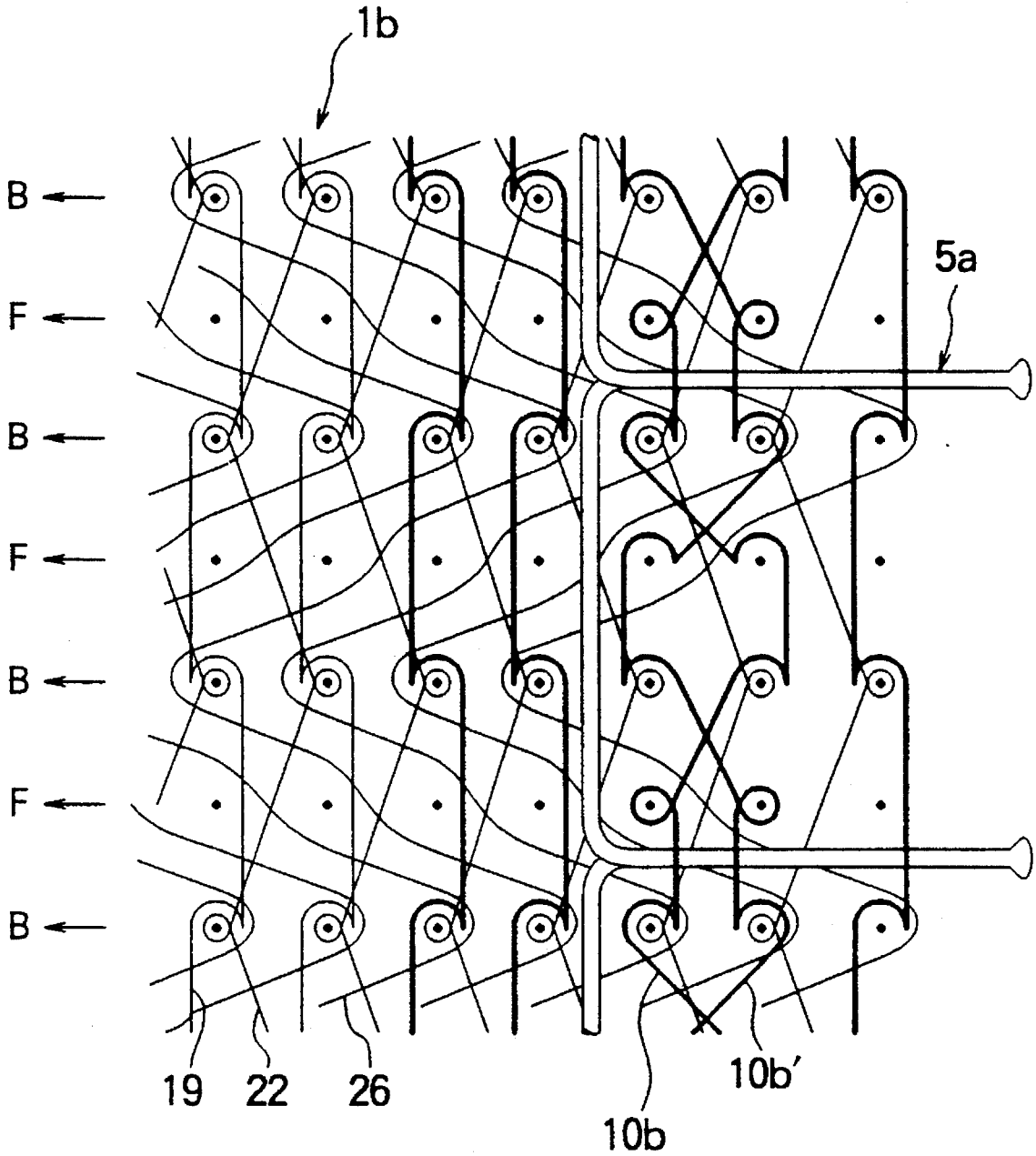
FIG. 10 is a point diagram of a knit slide fastener according to a third embodiment of the present invention.
Figure 11:
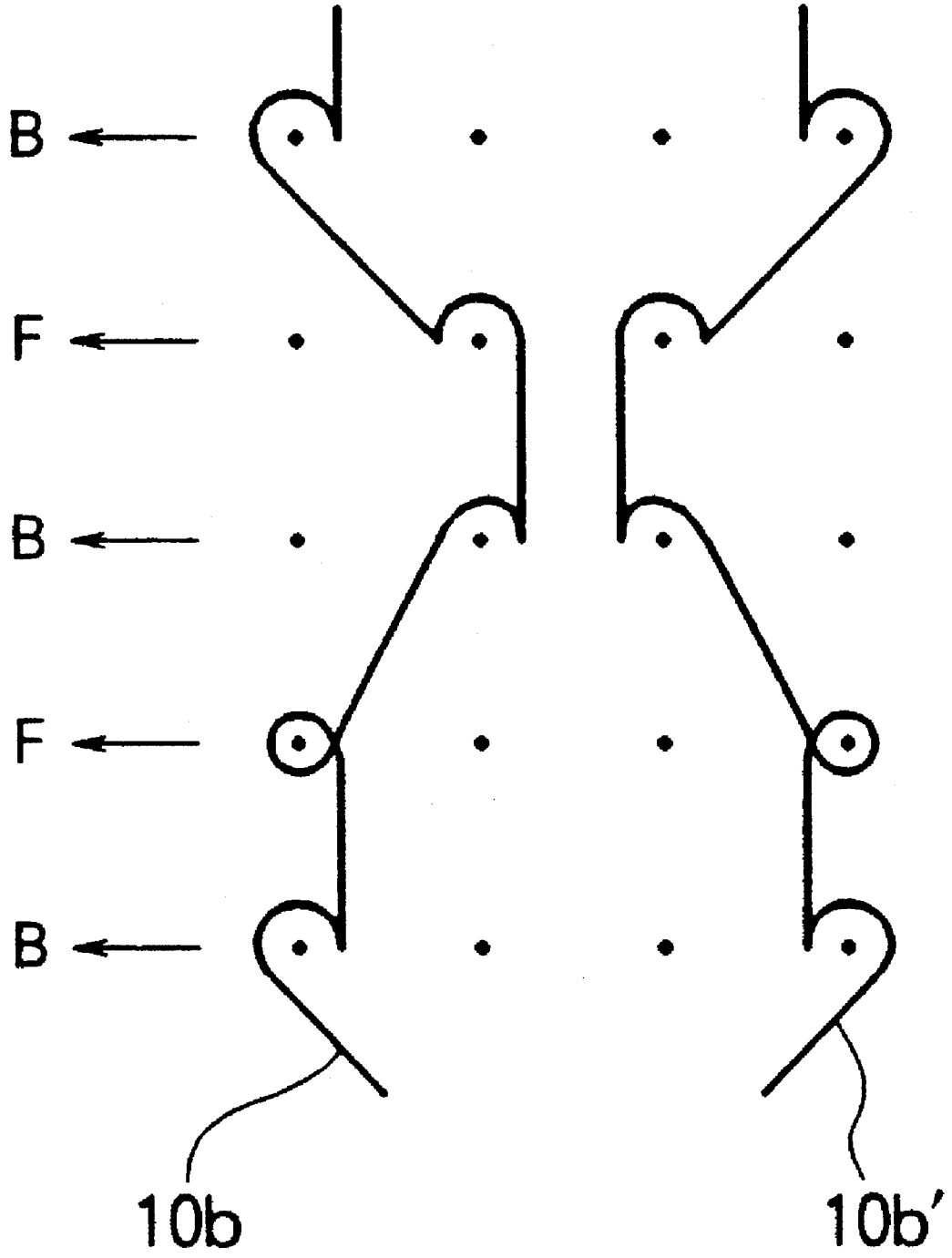
FIG. 11 is a point diagram showing the knitting pattern of binding chain-stitch threads of FIG. 10.

FIG. 10 illustrates in point diagram a fastener according to a third embodiment of the present invention, and FIG. 11 shows knitting patters of threads used in the third embodiment.

In the first and second embodiments described above, the two binding chain-stitch threads 10 used for restrainig or binding the upper and lower legs 6, 7; **6*a*, 7*a* of the coupling elements 5; 5*a*** are knit substantially linearly in and along the corresponding wales. Differing from the first and second embodiments, the third embodiment includes two binding chain-stitch threads (designated later) each extending in and across two adjacent wales to restrain or bind the row of continuous coupling elements.

Stated more specifically, the fastener includes a fastener tape **1*b* having a ground structure which, excepting for an element-supporting portion extending along one longitudinal edge thereof, is knit with chain-stitch threads 19, tricot-stitch threads 22 and laid-in weft threads 26 laid in a zigzag pattern and each extending across four adjacent wales 4 to withstand a transverse pulling force or load exerted on the fastener tape 1*b*. The element-supporting portion formed along the one longitudinal tape edge has two adjacent wales. A row of coiled coupling elements 5*a* is formed by reciprocating a synthetic resin monofilament transversely across the four wales in the element-supporting portion without changing the course. The row of coiled coupling elements 5*a* is attached to the element-supporting portion by two threads 10*b*, 10*b*' as the fastener tape 1*b* is knit, with their upper and lower legs restrained or bound by these threads 10*b*, 10*b*'. The threads 10*b*, 10*b*' are knit as binding chain stitches of a double-knit structure and each extends in and across the two adjacent wales, as shown in FIG. 10. The binding chain-stitch thread 10*b* is knit in a pattern of 2-1/1-2/1-0/0-1, while the binding chain-stitch thread 10*b*'** is knit in a pattern of 0-1/1-0/1-2/2-1.

During knitting, respective guide bars of the two binding chain-stitch threads **10*b*, 10*b*' are reciprocated symmetrically between two adjacent needles avoiding overlapping. The binding chain-stitch threads 10*b*, 10*b*' each have a series of longitudinally disposed upper needle loops extending on and along the row of continuous coupling elements 5*a***, and a series of longitudinally disposed lower needle loops intertwined with knitting threads on the ground structure side to form a fine knit structure.

Figure 12:
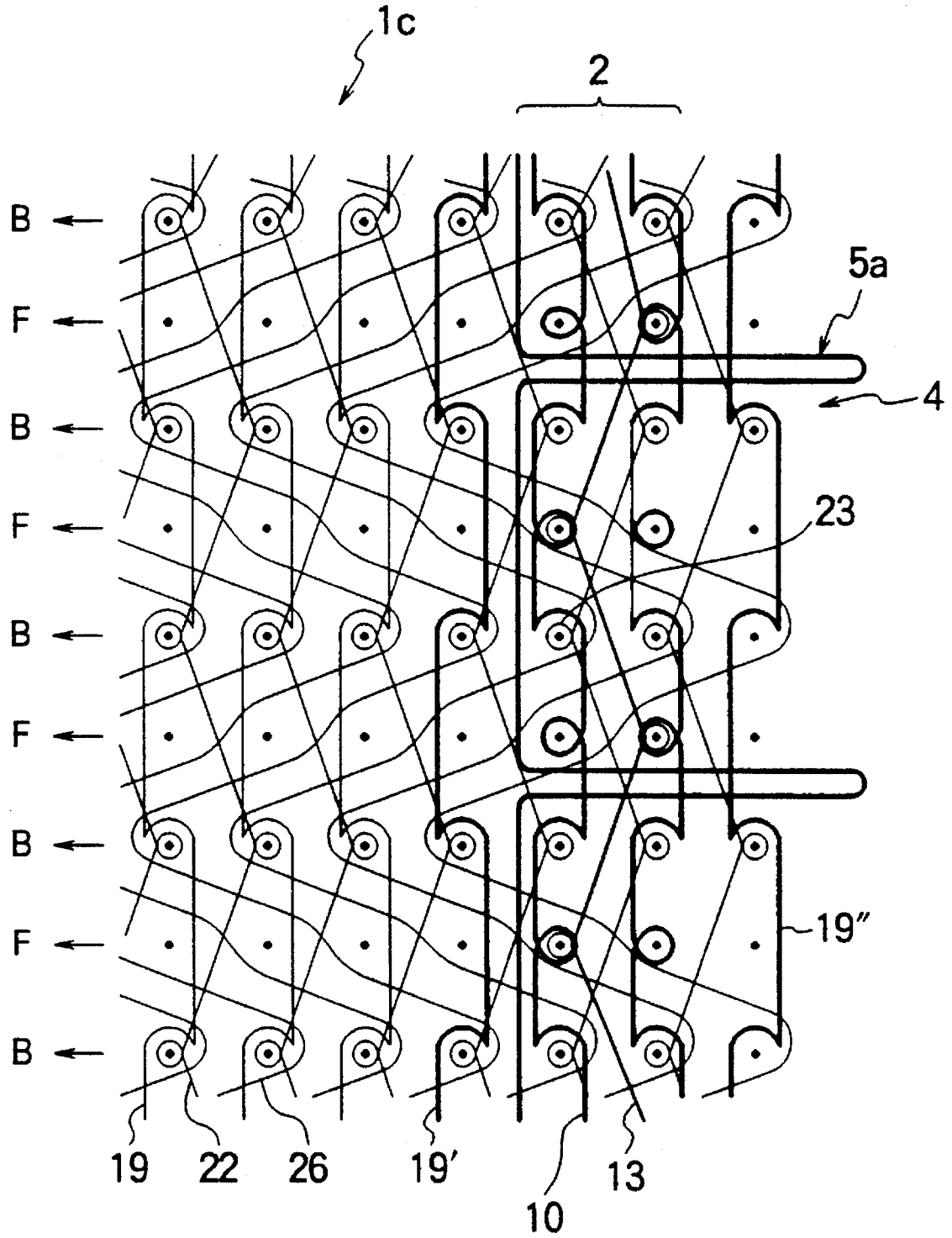
FIG. 12 is a point diagram of a knit slide fastener according to a fourth embodiment of the present invention.
Figures 13A, 13B, 13C, 13D, 13E:
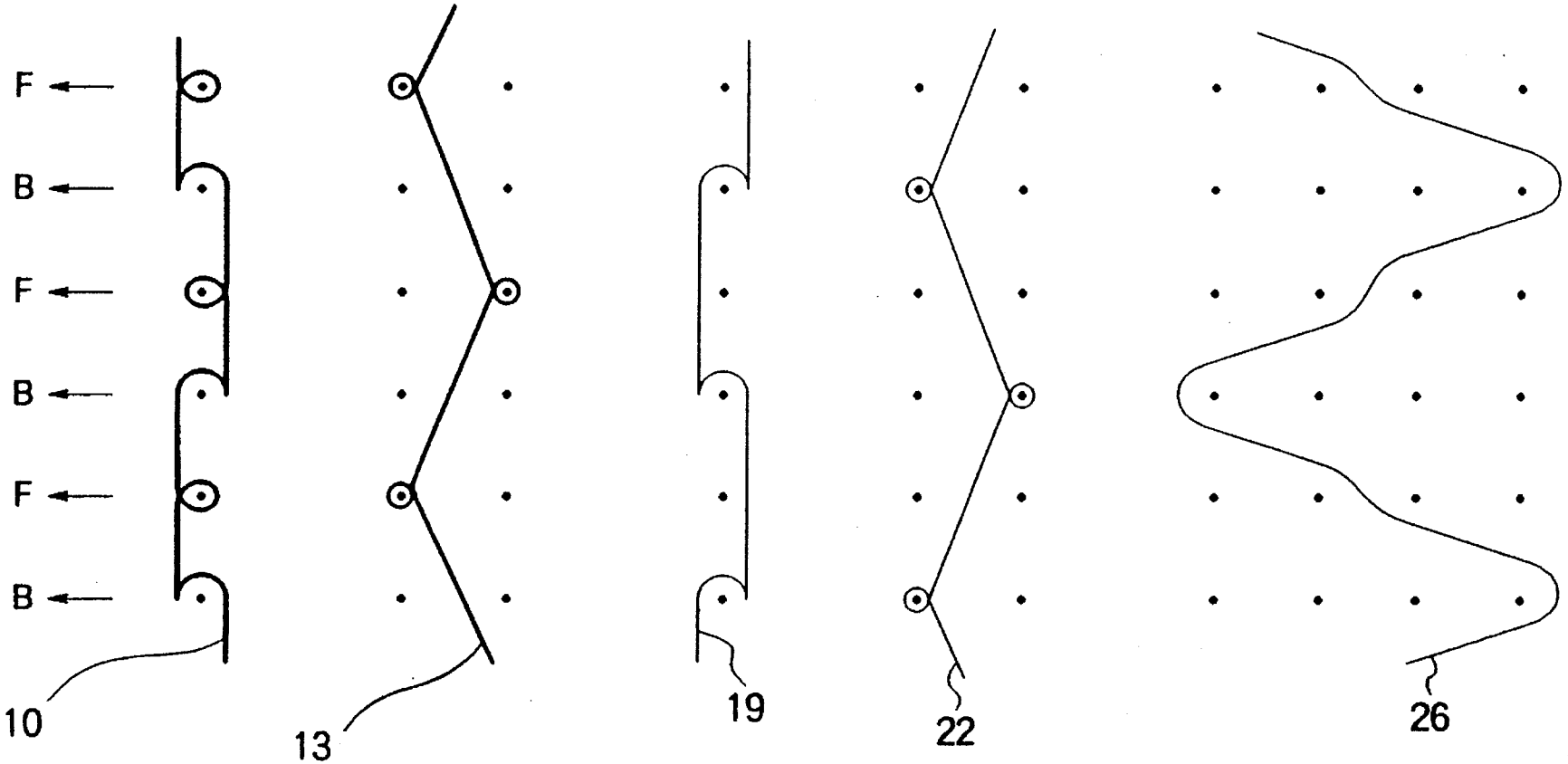
FIGS. 13(A)–13(E) are point diagrams showing knitting patterns of various threads of FIG. 12.
Figure 14:
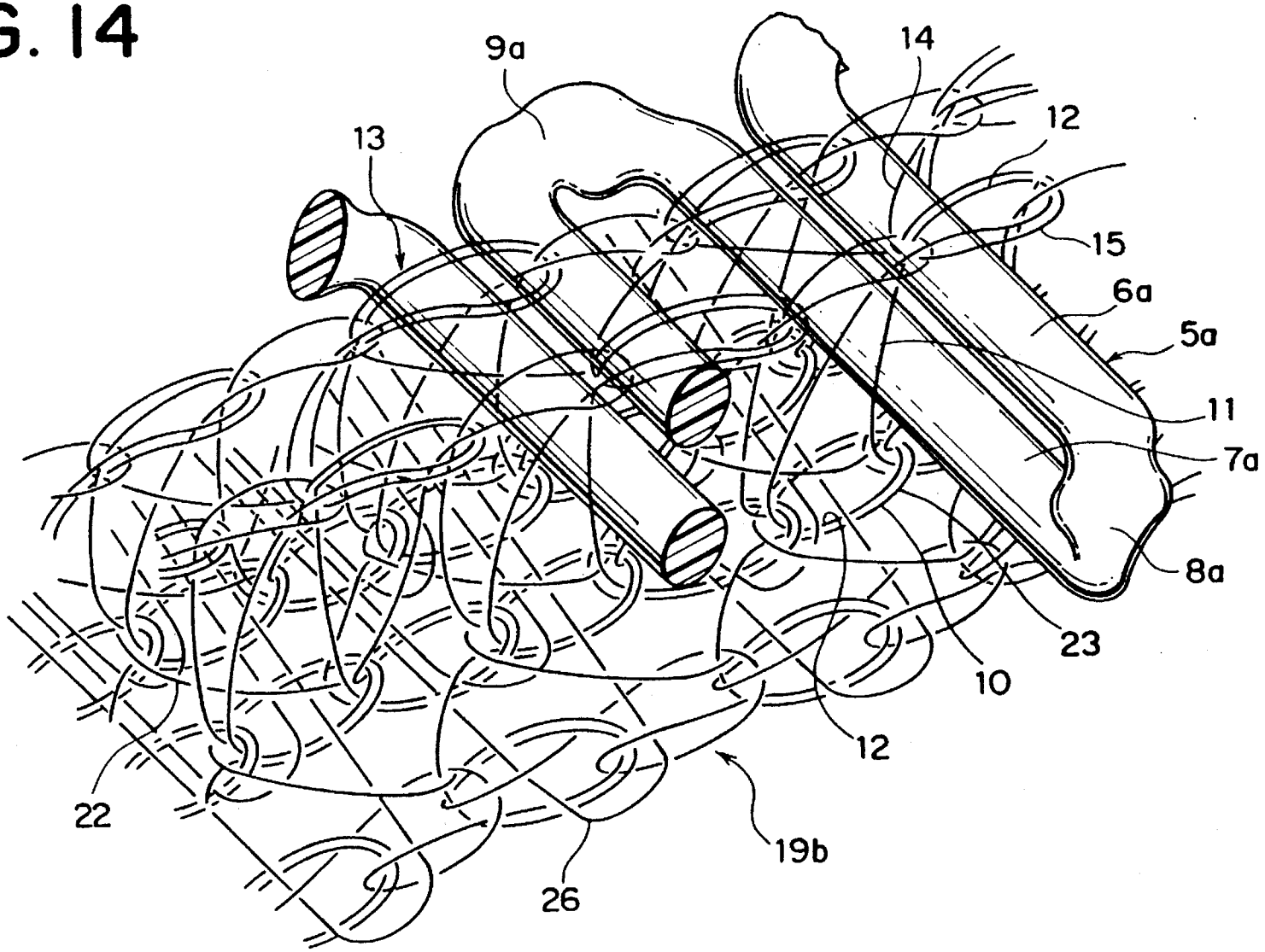
FIG. 14 is a diagrammatical perspective view of an essential portion of the slide fastener of FIG. 12, showing the manner in which a row of coupling elements is attached.
Figure 15:
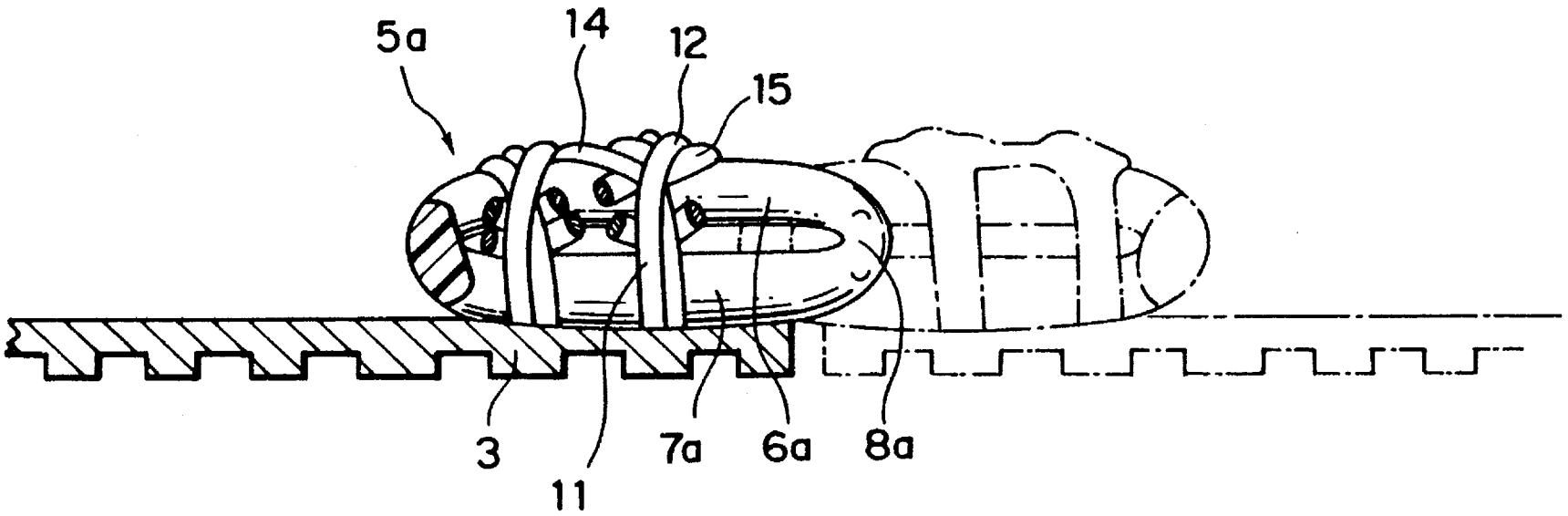
FIG. 15 is a transverse cross-sectional view of the slide fastener of FIG. 14.

FIG. 12 shows in point diagram a fastener according to a fourth embodiment of the present invention, FIGS. 13(A)–13(E) illustrate knitting patters of various threads used in the fourth embodiment, FIG. 14 diagrammatically illustrates in perspective view the manner in which a row of coupling elements of the fastener is attached, and FIG. 15 is a transverse cross sectional view of the fastener.

The fastener of the fourth embodiment includes a fastener tape 1*c* having a ground structure which, excepting for an element-supporting portion 2 extending along one longitudinal edge thereof, is composed of threads 19 knit as chain stitches having a pattern of 1-0/0-0/0-1/1-1 as shown in FIG. 13(C), threads 22 knit as tricot stitches having a pattern of 1-2/1-1/1-0/1-1 as shown in FIG. 13(D), and laid-in weft threads 26 laid in a zigzag pattern of 0-0/2-2/4-4/2-2 over the entire area of the fastener tape 1*c*, as shown in FIG. 13(E), and each extending across four adjacent wales to withstand a lateral pulling force or load exerted on the fastener tape 1*c*. The laid-in weft threads 26 may be replaced by a laid-in weft thread laid in every course transversely across all the wales of fastener tape 1*c* and extending longitudinally in a zigzag pattern along the length of the fastener tape 1*c*. The element-supporting portion 2 extending along the one longitudinal tape edge portion has two adjacent wales to which a row of coiled coupling elements 5*a* is attached as the fastener tape 1*c* is knit. The row of coiled coupling elements 5*a* is formed from a monofilament of synthetic resin, such as nylon or polyester, which is laid by reciprocating the monofilament transversely across the element-supporting portion 2 in every four courses 4 without changing the course, as shown in FIG. 12. The row of coupling elements 5*a* is attached, with upper and lower legs 6*a* and 7*a* restrained or bound jointly by two threads 10 knit as binding chain stitches of a double-knit structure having a pattern of 0-1/1-0/1-0/0-1, as shown in FIG. 13(A), and extending respectively along the two adjacent wales, and a thread 13 knit as binding tricot stitches having a pattern of 1-1/1-2/1-1/1-0 as shown in FIG. 13(B), and extending in and across the two adjacent wales.

More specifically, in the point diagram shown in FIG. 12, the needle position of front needles arranged in every other courses is designated by F, and the needle position of back needles arranged alternately with the front needles is designated by B. On front needles F, the binding chain-stitch threads each form one needle loops 12 overlying the upper surface of the row of coiled coupling elements 5*a* being knit in the fastener tape 1*c*. In the illustrated embodiment, each of the binding chain-stitch threads 10 knit as a double-knit structure has a series of upper needle loops 12 each of which is interlocked with the succeeding needle loop 12 of the same binding chain-stitch thread 10, as shown in FIG. 14. By repeating this knitting procedure, two parallel juxtaposed chain stitches are formed longitudinally on and along the upper surface of the row of coiled coupling elements 5*a* and restrain or bind the upper and lower legs 6*a*, 7*a* of the respective coupling elements 5*a* to secure the coupling elements 5*a* to the fastener tape, as shown in FIG. 15. On the front needles F, the upper needle loops 12 of the two parallel juxtaposed binding chain-stitch threads 10, which are knit on the upper surface side of the row of coiled coupling elements 5*a*, are intertwined with needle loops 15 of the binding tricot-stitch thread 13 having a single-knit structure, so that the upper surface of the row of coiled coupling elements 5*a* is covered jointly with the upper needle loops 12 of the binding chain-stitch threads 10 and the needle loops 15 of the binding tricot-stitch thread 13, as shown in FIG. 15. Thus, a finely knit binding structure having a desired width is formed on the upper surface of the row of coiled coupling elements 5*a*. On the back needles B, a tape portion of the fastener tape 1*c* and a part of the element-supporting portion 2 adapted to support the row of coupling elements 5*a* at one longitudinal tape edge are knit. In the illustrated embodiment, the tape portion of the fastener tape 1*c* is knit with the chain-stitch threads 19, the tricot-stitch threads 22 and the laid-in weft threads 26. On the other hand, the part of the element-supporting portion 2 adapted to support the row of coupling elements 5*a* is devoid of chain-stitch threads 19 and knit only with the tricot-stitch threads 22 and the laid-in weft threads 26. As shown FIG. 14, the binding chain-stitch threads 10 having the double-knit structure also have lower needle loops 12 intertwined with needle loops 23 of the tricot-stitch thread 22 to form fine knit structure. Apart from the illustrated embodiment, the part of the element-supporting portion 2 adapted to support the row of coupling elements 5*a* may include the chain stitches with due consideration of a desired denseness of the stitches to ensure smooth operation of the knitting needles. Designated by 14 shown in FIGS. 14 and 15 are sinker loops of the binding tricot-stitch thread 13.

As shown in FIGS. 14 and 15, the two parallel juxtaposed binding chain-stitch threads 10 of the double-knit structure each have a series of sinker loops 11 each disposed in an inter-element space defined between two adjacent ones of the coupling elements 5*a*, so that the upper and lower legs 6*a* and 7*a* of each coupling element 5*a* are forcibly aligned or superposed in a direction perpendicular to an upper surface (mounting surface) of the element-supporting portion 2. Partly because the binding tricot-stitch thread 13 extends on and along the upper surface of the row of coupling elements 5*a*, and partly because the tricot-stitch threads 22 of the ground structure of the fastener tape 1*c* are present on the mounting surface of the element-supporting portion 2, the row of coupling elements 5*a* is covered on its upper and lower surfaces with the threads of the same knitting structure. The front needles F and the back needles B can, therefore, operate under the substantially same condition with the result that the knit slide fastener can be manufactured smoothly at high speed without involving a thread breakage failure which would otherwise be caused by undue local knitting load exerted on the warp-knitting machine. Furthermore, the two binding chain-stitch threads 10 are intertwined with the binding tricot-stitch thread 13 on the upper surface of the row of coupling elements 5*a* so that the binding chain-stitch threads 10 are protected against lateral displacement and, hence, the row of coupling elements 5*a* are secured firmly to the element-supporting portion 2 while maintaining a stable mounting posture of the coupling elements 5*a*. An accidental chain rupture or splitting of the two opposed rows of coupling elements 5*a* can, therefore, be avoided.

Figure 16:
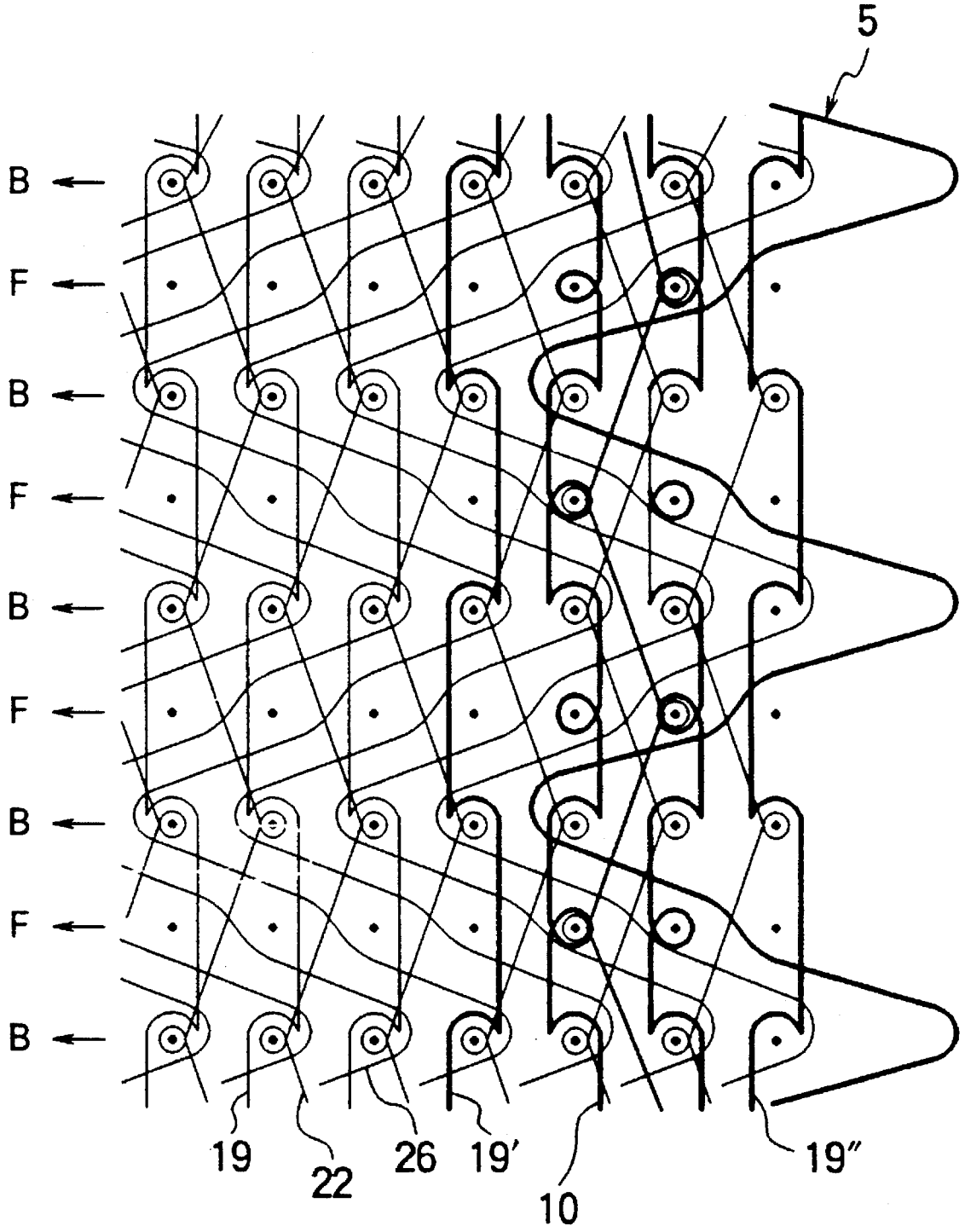
FIG. 16 is a point diagram of a knit slide fastener according to a fifth embodiment of the present invention.
Figure 17:
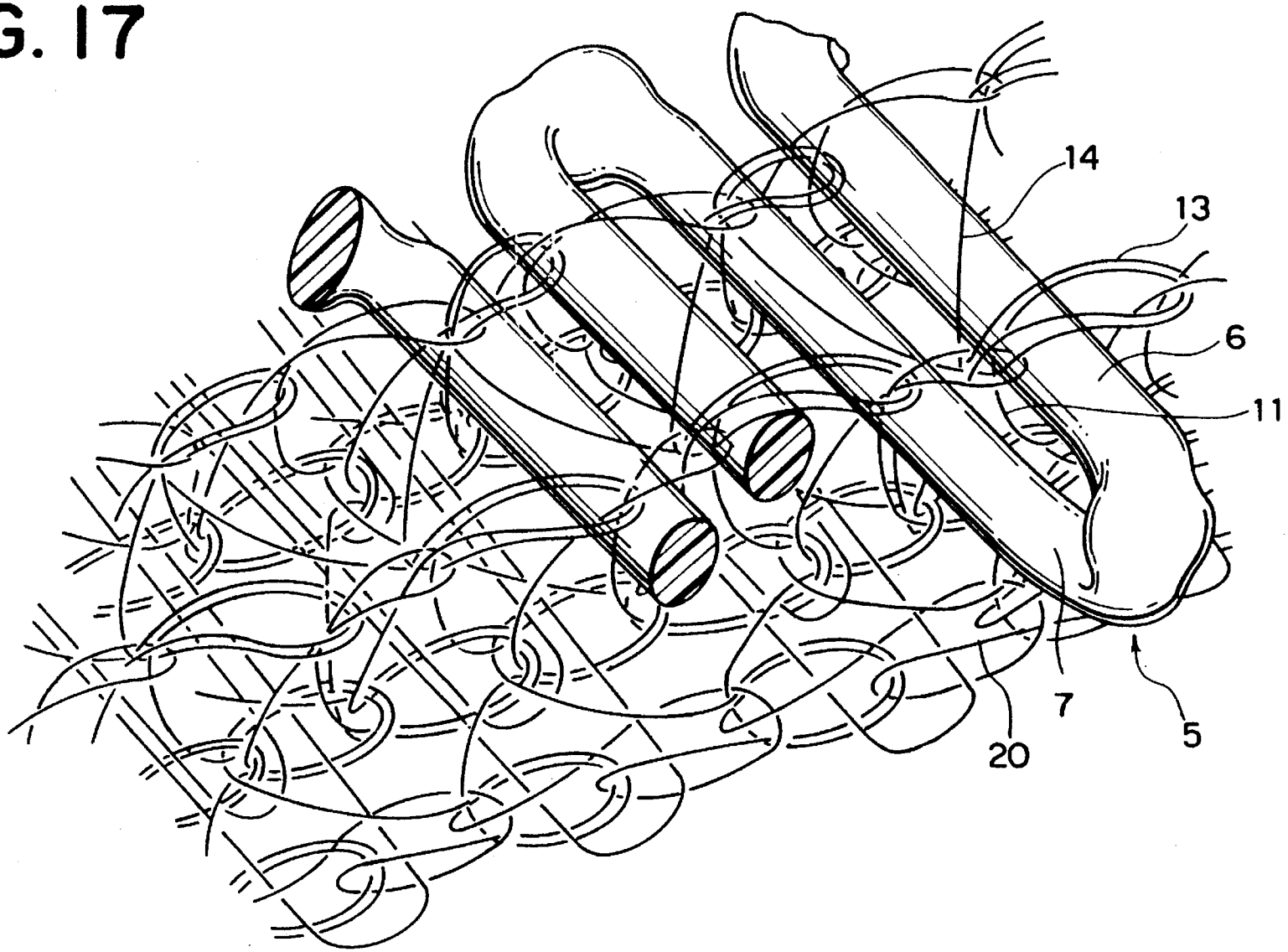
FIG. 17 is a diagrammatical perspective view of an essential portion of the slide fastener of FIG. 16, showing the manner in which a row of coupling elements is attached.

FIG. 16 shows in point diagram a fastener according to a fifth embodiment of the present invention, and FIG. 17 is a diagrammatical perspective view illustrative of the manner in which a row of continuous coupling elements of the fastener is attached.

The fastener of the fifth embodiment is differentiated from the fastener of fourth embodiment by the manner in which a monofilament used for forming a row of coiled coupling elements is laid in. In the fourth embodiment, the monofilament is reciprocated in the same course to form one coupling element 5*a* having a pair of vertically aligned or superposed upper and lower legs 6*a* and 7*a*, and the binding chain-stitch threads 10 each have a succession of sinker loops 11 each disposed between an inter-element space defined between each pair of adjacent coupling elements 5*a* to secure the coupling elements 5*a* to the fastener tape 1*c* with their upper and lower legs 6*a*, 7*a* restrained or bound from the above. As against the fourth embodiment, a monofilament of the fifth embodiment is laid in by reciprocating it in such a manner as to have forward and backward strokes along different courses, as shown in FIG. 16, and the binding chain-stitch threads 10 each have a succession of sinker loops 11 each disposed between the upper leg 6 and the lower leg 7 of each coupling element 5 to secure the coupling elements 15 to the fastener tape, with their upper and lower legs 6 and 7 restrained or bound separately. With this arrangement, the row of coiled coupling elements 5 is held stably in position against lateral displacement and has an improved dimensional stability in the lengthwise direction, so that the function of the fastener is further improved. Knitting threads forming the fastener tape and knitting threads binding the row of coupling elements in the fifth embodiment are the same as those used in the fourth embodiment and knit in the patterns shown in FIG. 13.

Figure 18:
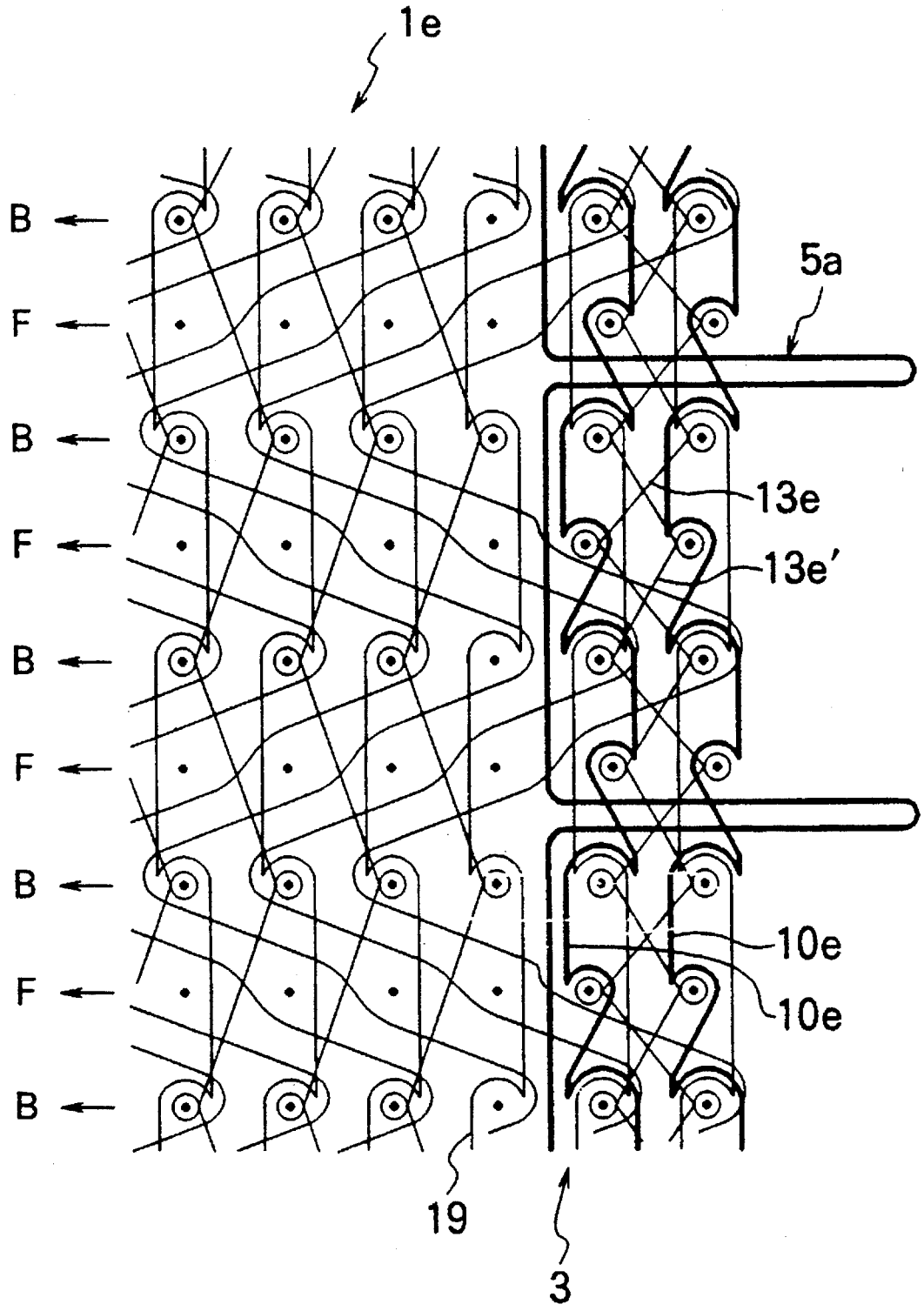
FIG. 18 is a point diagram of a knit slide fastener according to a sixth embodiment of the present invention.
Figures 19A, 19B, 19C:
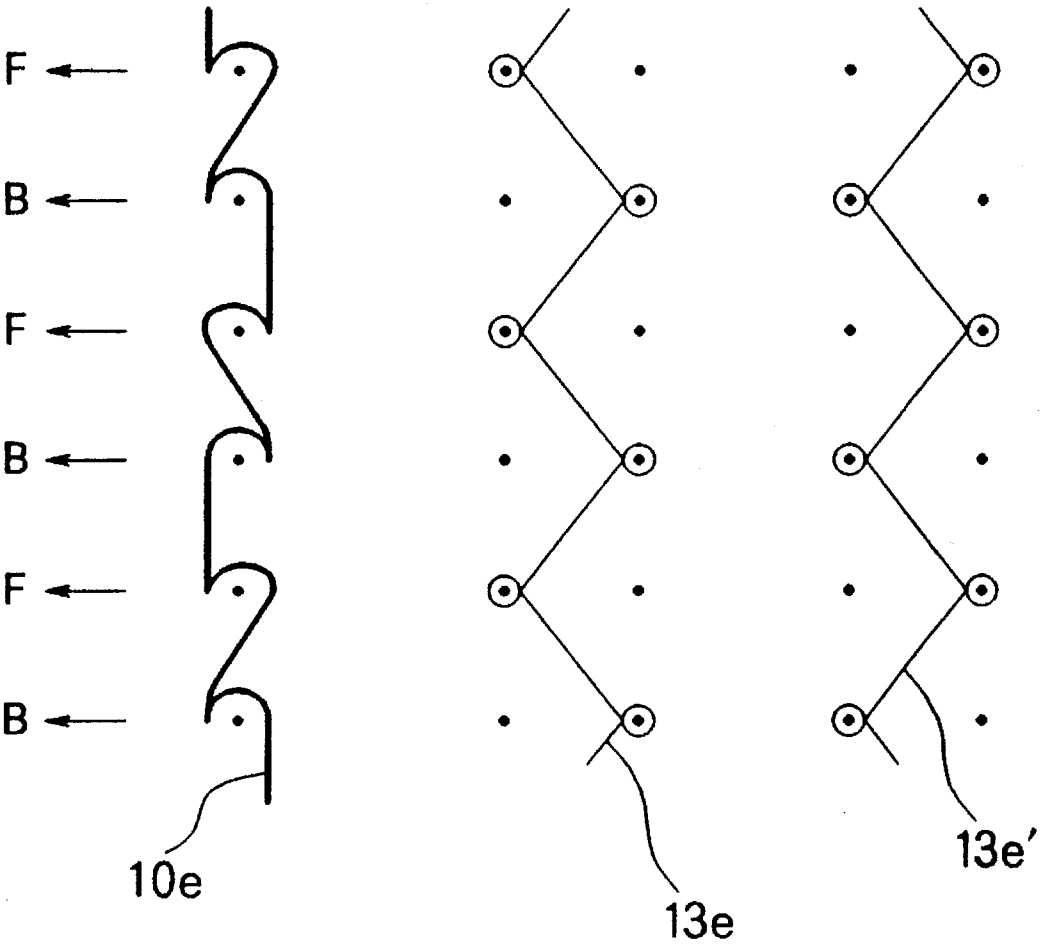
FIGS. 19(A)–19(C) are point diagrams showing knitting patterns of various threads of FIG. 18.
Figure 20:
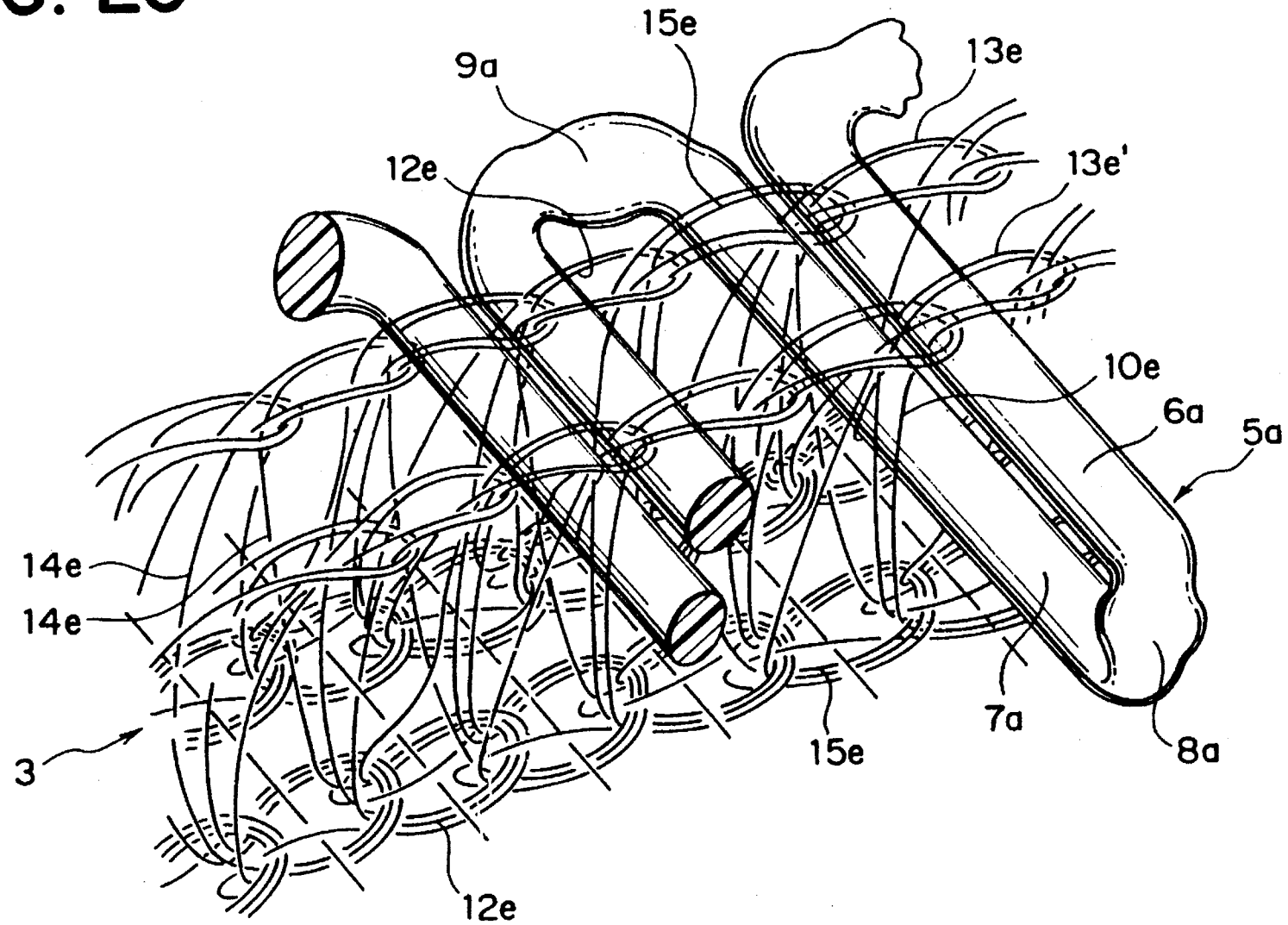
FIG. 20 is a diagrammatical perspective view of an essential portion of the slide fastener of FIG. 18, showing the manner in which a row of coupling elements is attached.
Figure 21:
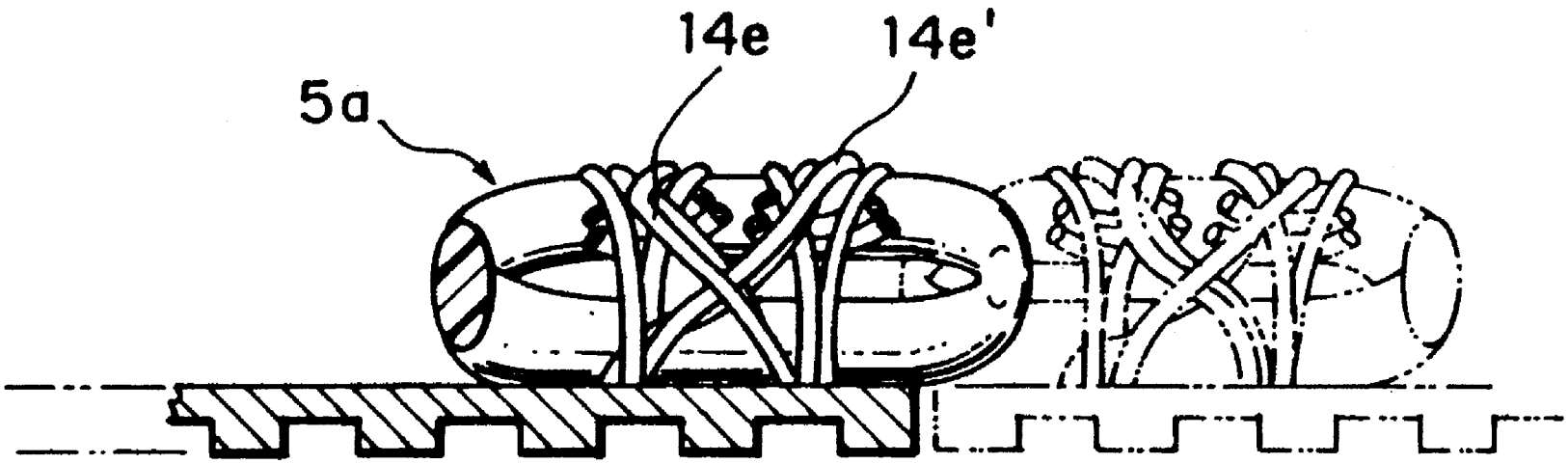
FIG. 21 is a transverse cross-sectional view of the slide fastener of FIG. 20.

FIGS. 18 and 20 shows a fastener according to a sixth embodiment of the present invention (in FIG. 20, for purposes of illustration, tricot-stitch threads on the fastener tape side are omitted, and laid-in weft threads are indicated by a single solid line running in each course). The fastener of the sixth embodiment is substantially the same as the fastener of the first embodiment shown in FIG. 1 with the exception that in addition to two binding chain-stitch threads 10*e* having a different pattern and a row of coupling elements 5*a* laid in a different pattern, two binding tricot-stitch threads 13*e*, 13*e*' are added to secure the row of coupling elements 5*a*. The binding chain-stitch threads 10*e* are knit as open-loop double-knit chain stitches having a pattern of 0-1/0-1/1-0/1-0, as shown in FIG. 19, and used for binding the row of coiled coupling elements 5*a*. The binding tricot-stitch threads 13*e*, 13*e*' are knit as tricot-stitches of a double-knit structure for binding the row of coupling elements 5*a*. One of the binding tricot-stitch threads 13*e* has a pattern of 1-0/1-2, as shown in FIG. 19(B), and the other binding tricot-stitch thread 13*e*' has a pattern of 1-2/1-0, as shown in FIG. 19(C). The binding tricot-stitch thread 13*e* is knit in such a manner that firstly, and a back needle B it is intertwined with one of successive needle loops of the chain-stitch thread 19 forming the ground structure of a fastener tape 1*e* along an outermost wale 3, subsequently, on a front needle F it forms one needle loop 15*e* disposed on the upper leg 6*a* of a corresponding coupling element 5*a* adjacent to the connecting portion 9*a* thereof and intertwined with a corresponding one of successive needle loops 12*e* of the binding chain-stitch thread 10*e* extending along a second outermost wale 3, and thereafter, on the back needle B it is intertwined with the succeeding needle loop of the chain-stitch thread 19 forming the ground structure along the outermost wale 3. On the other hand, the binding tricot-stitch thread 13*e*' is knit in such a maimer that firstly on a back needle B, it is intertwined with one of successive needle loops of the chain-stitch thread 19 forming the ground structure of a fastener tape 1*e* along the second outermost wale 3, subsequently, on a front needle F it forms one needle loop 15e disposed on the upper leg 6*a* of a corresponding coupling element 5*a* adjacent to the coupling head 8*a* thereof and intertwined with a corresponding one of successive needle loops 12*e* of the binding chain-stitch thread 10*e* extending along the outermost wale 3, and thereafter, on the back needle B it is intertwined with the succeeding needle loop of the chain-stitch thread 19 forming the ground structure along the second outermost wale 3. Each of the two binding tricot-stitch threads 13*e* and 13*e*' has a plurality of sinker loops 14*e*, 14*e*' each disposed between the adjacent coupling elements 5*a* and knit as diagonally intersecting with each other, as shown in FIG. 21, thereby preventing the binding chain-stitch threads 10*e* from displacing laterally and pulling the row of coiled coupling elements 5*a* toward the fastener tape 1*e* to firnly anchor the same. The binding chain-stitch threads 10*e* and the binding tricot-stitch threads 13*e*, 13*e*' jointly form a composite stitch structure extending over the upper surface of the row of coupling elements 5*a*. This is particularly advantageous in that even when a part of the composite stitch structure is worn off due to sliding movement of a slider or during use of the fastener, the remaining part of the composite stitch structure can reliably retain the coupling elements on the fastener tape 1*e*.

In the sixth embodiment shown in FIGS. 18 and 19, the fastener tape 1*e* does not include tricot-stitch thread forming a part of the ground structure at the element-supporting portion, however, the element-supporting portion may include the tricot-stitch threads.

Figure 22:
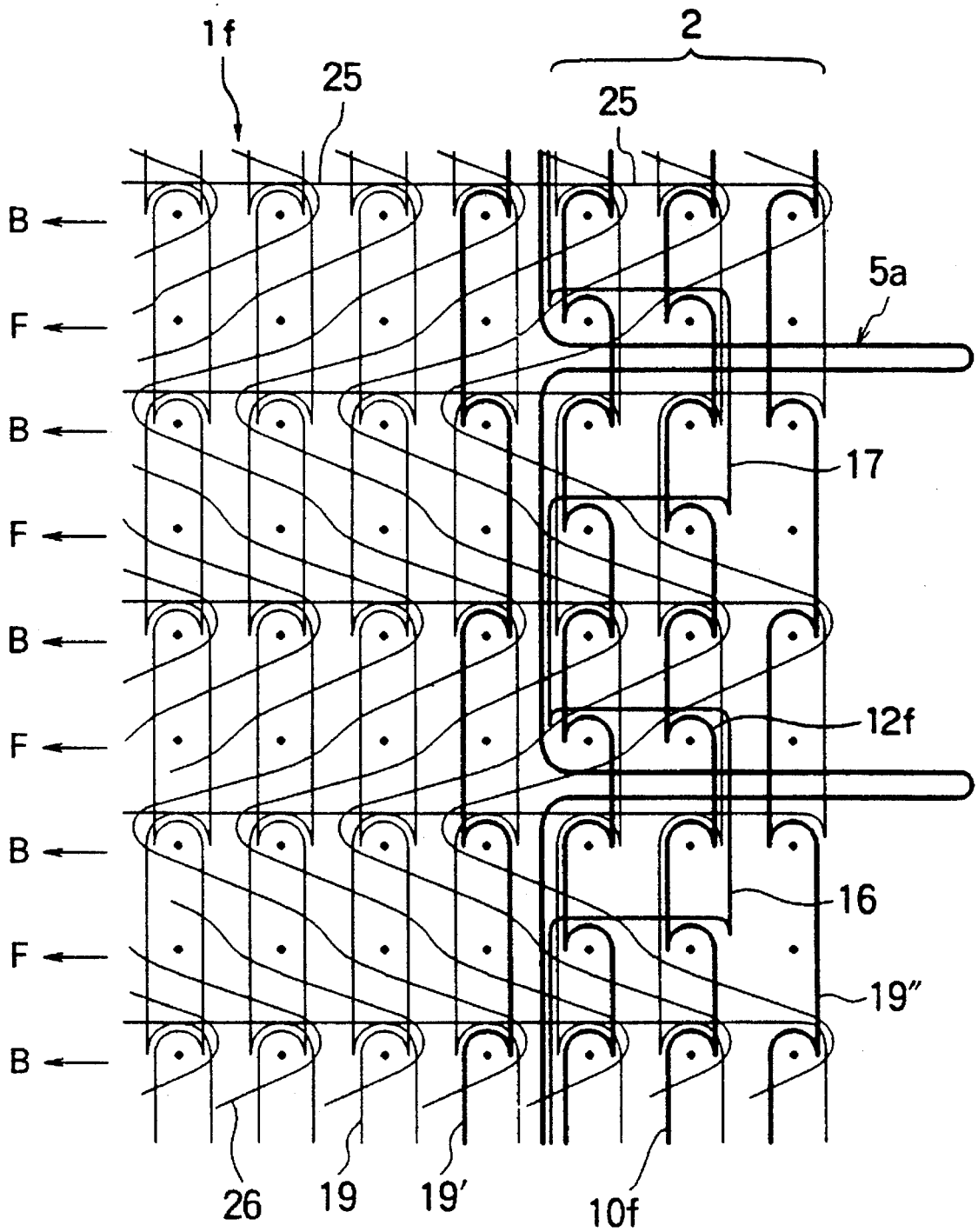
FIG. 22 is a point diagram of a knit slide fastener according to a seventh embodiment of the present invention.

FIG. 22 shows in point diagram a fastener according to a seventh embodiment of the present invention, and FIGS. 23(A)–23(E) illustrate knitting patterns of various threads used in the seventh embodiment.

Figures 23A, 23B, 23C, 23D, 23E:
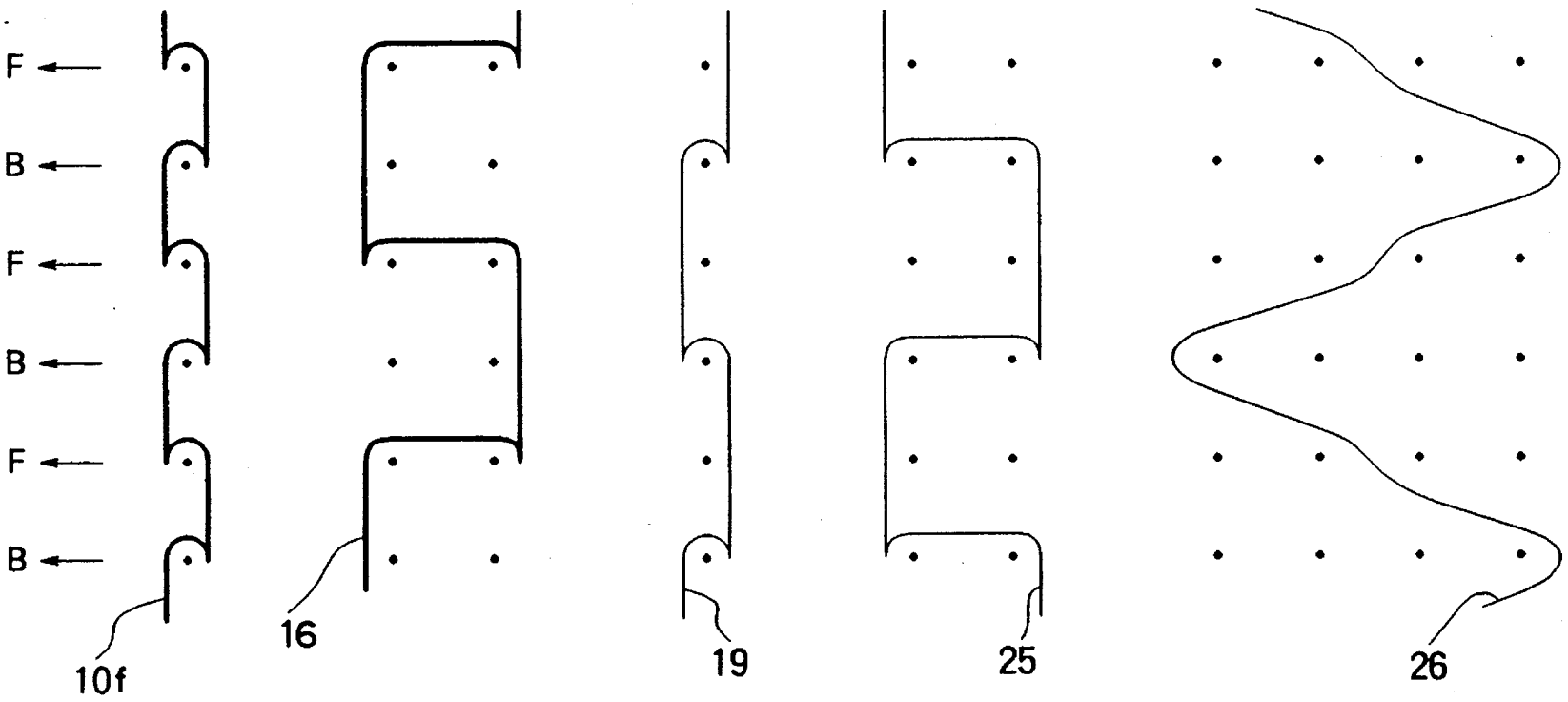
FIGS. 23(A)–23(E) are point diagrams showing knitting patterns of various threads of FIG. 22.

The fastener of the seventh embodiment differs from the fourth embodiment of FIG. 12 in that the tricot-stitch threads 22 for forming a part of the ground structure of the fastener tape and the binding tricot-stitch threads 13 extending over the upper surface of the row of coupling elements in the fourth embodiment are replaced respectively by threads 25 knit as two-needle stitches and a thread 16 knit as binding two-needle stitches, in order to keep the two binding chain-stitch threads 10*f* in position against lateral displacement, thereby improving the dimensional stability of the fastener in the transverse direction. The fastener of the seventh embodiment includes a fastener tape 1*f* having a ground structure which is composed of threads 19 knit as chain stitches having a pattern of 1-0/0-0/0-1/1-1, as shown in FIG. 23(C), threads 25 knit as two-needle stitches having a pattern of 0-2/2-2/2-0/0-0, as shown in FIG. 23(D), and laid-in weft threads 26 laid in a zigzag pattern of 0-0/2-2/4-4/2-2, and each extending across four adjacent wales, as shown in FIG. 23(E). A row of coiled coupling elements 5*a* is formed from a monofilament which is reciprocated once in the same course in the same manner as done in the fourth embodiment. The row of coiled coupling elements 5*a* is secured by two threads 10*f* knit as binding open-loop chain stitches of a double-knit structure having a pattern of -0/0-1/1-0/0-1, as shown in FIG. 23(A). In addition of the binding chain-stitch threads 10*f*, a thread 16 knit as binding two-needle stitches of a single-knit structure having a pattern of 2-2/2-0/0-0/0-2 as shown in FIG. 23(B) runs between two needles on which the binding chain-stitch threads 10*f* are knit. The binding two-needle-stitch threads 16 is knit on the front needles F and has a succession of sinker loops 17 extending over the upper surface of the row of coupling elements 5*a* to restrain or bind the coupling elements 5*a* from the above. A portion of the element-supporting portion 2 adapted to support thereon the row of coupling elements 5*a* is knit with the two-needle-stitch threads 25 of the ground structure which has the same knit structure as the binding two-needle-stitch thread 16 extending over the upper surface of the row of coupling elements 5*a*. The front and back needles F and B can, therefore, operate under the substantially same knitting condition and hence are not subjected to undue local knitting load. Consequently, the fastener can be produced smoothly at high speed.

Figure 24:
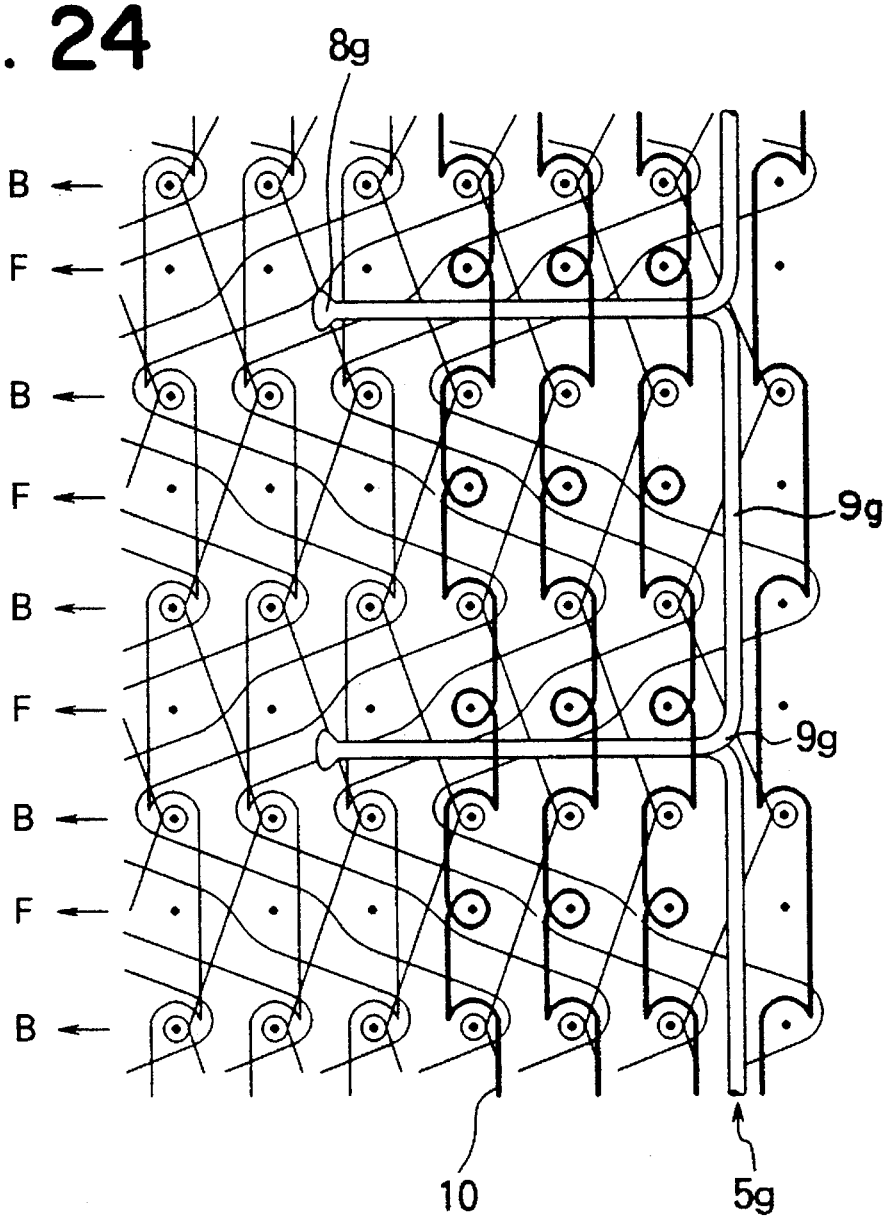
FIG. 24 is a point diagram of a knit slide fastener according to an eighth embodiment of the present invention.
Figure 25:
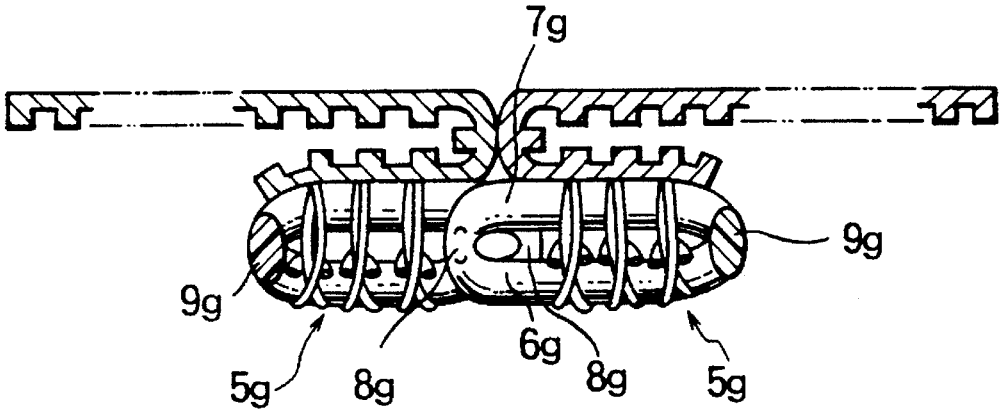
FIG. 25 is a transverse cross-sectional view of the slide fastener of FIG. 24, diagrammatically showing the manner in which a row of coupling elements is attached.

FIG. 24 shows in point diagram a fastener according to an eight embodiment of the present invention, and FIG. 25 diagranmatically illustrates in transverse cross section the manner in which a row of coupling elements of the fastener is attached. The fastener of the eighth embodiment is a concealed slide fastener including a row of coiled coupling elements 5g formed from a monofilament and each having a coupling head and a connecting portion arranged in opposite orientation to those of the coupling element used in the fourth embodiment shown in FIG. 15. The monofilament is reciprocated once in the same course to form one coupling element 5g having a pair of vertically aligned or superposed upper and lower legs 6g and 7g, a coupling head 8g located near an inner edge of the element-supporting portion (or directed away from one longitudinal tape edge portion including the element-supporting portion), and a connecting portion 9g located near the one longitudinal tape edge. The row of coupled coupling elements 5g is attached to the element-supporting portion simultaneously with knitting of the fastener tape, with the upper and lower legs 6g and 7g restrained or bind from above by three threads 10 knit as binding chain stitches having a double-knit structure. The element-supporting portion is folded back as shown in FIG. 25, and the row of coiled coupling elements 5g is coupled with a mating row of coiled coupling elements 5g to complete a concealed fastener. In the manner described above, the fastener of each of the foregoing embodiments including the fourth embodiment may be converted into a concealed slide fastener.

Figure 26:
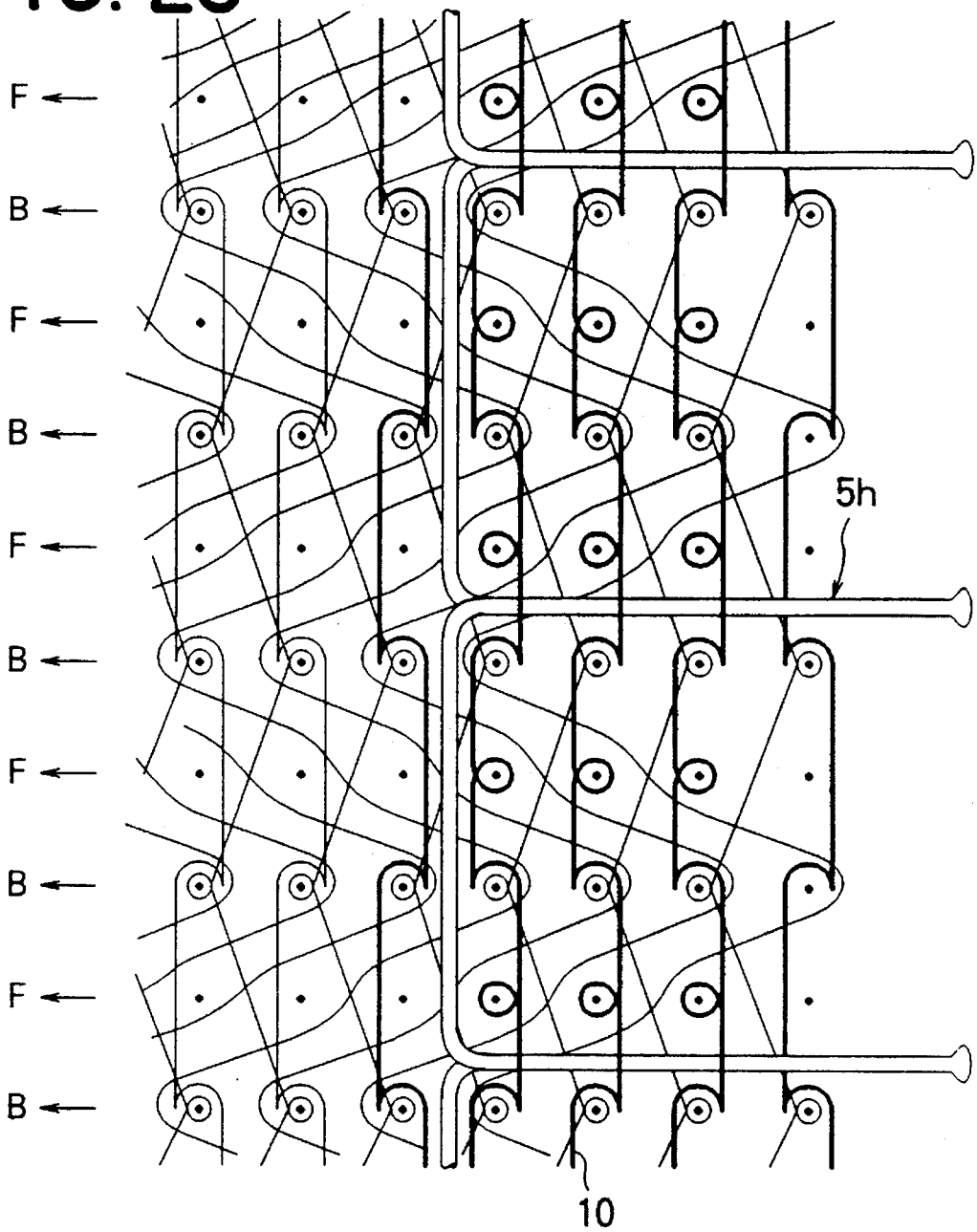
FIG. 26 is a point diagram of a knit slide fastener according to a ninth embodiment of the present invention.
Figure 27:
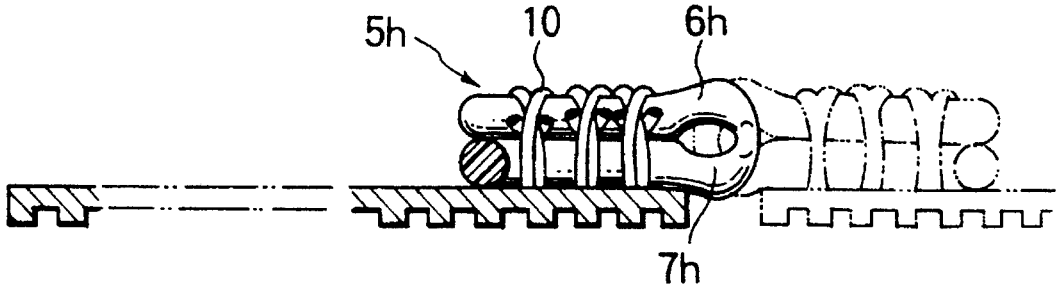
FIG. 27 is a transverse cross-sectional view of the slide fastener of FIG. 26, diagrammatically showing the manner in which a row of coupling elements is attached.

FIG. 26 shows in point diagram a fastener according to a ninth embodiment of the present invention, and FIG. 27 diagrammatically illustrates in transverse cross section the manner in which a row of coupling elements of the fastener is attached.

The fastener of the ninth embodiment differs from ones of the foregoing embodiments in that a row of continuous synthetic resin coupling elements 5h of the so-called "zigzag" type is used in place of the row of coiled coupling elements. As shown in FIG. 26, the row of zigzag coupling elements 5h is composed of a plurality of alternating upper and lower coupling-element members each having a horizontal U shape as viewed from the plane and connected together to form the coupling elements in a zigzag shape extending along one longitudinal tape edge. Simultaneously with knitting of the fastener tape, the row of zigzag coupling elements 5h is knit into one longitudinal edge portion of the fastener tape, with a pair of vertically aligned upper and lower legs 6h and 7h of each coupling element 5h restrained or bound from the above by means of three binding chain-stitch threads 10.

The row of zigzag coupling elements may be employed in place of the row of coiled coupling elements used in any one of the preceding embodiments.

As described above, the present invention provides a knit slide fastener which includes a row of continuous coupling elements knit into an element-supporting portion of one longitudinal edge of a warp-knit fastener tape as the fastener tape is knit, and a thread knit as binding chain stitches of a double-knit structure into the element-supporting portion to secure the row of coupling elements with high dimensional stability. In the embodiments described above, two or three such binding chain-stitch threads are used. However, the number of the binding chain-stitch thread should preferably be determined depending on the size of the coupling elements used. The element-supporting portion has a width variable with thee number of the binding chain-stitch thread used. In general, the width of the element-supporting portion is equal to a combined width of two or three adjacent wales extending along one longitudinal tape edge. A first or an outermost one of these wales may or may not be used for securing the coupling elements. Since the outermost wale tends to become compacted this wale is preferably formed by using a thick knitting thread.

For purposes of illustration, threads shown in FIGS. 3, 7, 14, 17 and 20 are illustrated as being composed of thin threads and knit together to form loose stitches. In practice, the thickness or diameter of each thread is determined in view of the necessary functions of a desired fastener and the stitches are formed tightly.

The binding chain-stitch threads, binding tricot-stitch threads, and binding two-needle-stitch thread may be composed of threads which are thicker and has a greater heat-shrinkability than the chain-stitch threads, tricot-stitch threads, and two-needle-stitch threads forming the ground structure of the fastener tape. When a finished fastener is subjected to a heat-setting process, the thick and highly heat-shrinkable threads are thermally shrunk and thereby bind the coupling elements more tightly than before, so that the row of coupling elements is firmly attached to the fastener tape with improved dimensional stability. Preferably, one thread 19' (FIGS. 12, 16 and 22) of the chain-stitch threads extending along the wale located inwardly next to the two or three binding chain-stitch threads is composed of a thread thicker than the chain-stitch threads of the other wales of the tape portion so as to increase a resistance against abrasive wear caused due to sliding movement of the slider. It is also preferable that the chain-stitch thread 19" (FIGS. 12, 16 and 22) extending along the outermost wale of the ground structure of the fastener tape is composed of a thread thicker than the chain-stitch threads of the wales of the tape portion so as to enlarge the outermost wale to thereby reinforce the longitudinal tape edge to retain the shape of the same.

In the embodiments described above the tape portion, of the fastener tape and a portion of the fastener tape adapted to support thereon the row of continuous coupling elements are knit on the back needles B, and a binding knit structure used for anchoring the row of continuous coupling elements is knit on the front needles F. It is also possible according to the present invention that the tape portion and element-supporting portion of the fastener tape are knit on the front needles F, while the binding knit structure used for anchoring, the row of continuous coupling elements is knit on the back needles B.

In many embodiments described above, the binding chain-stitch threads are so knit as to form closed loop stitches on the upper surface of the row of continuous coupling elements. They may be knit to form open loop stitches on the upper surface of the row of continuous coupling elements. Similarly, the binding chain-stitch threads so knit as to form open loop stitches on the element-supporting side may be replaced by those forming closed loop stitches. Furthermore, all of the stitches formed by the binding chain-stitch threads may be composed of open loop stitches or alternatively of closed loop stitches. When a synthetic resin monofilament is supplied to the warp knitting machine for forming a row of continuous coupling elements, a core cord may be supplied concurrently in such a manner that the core cord is inserted between upper and lower legs throughout the length of the row of continuous coupling elements, and also disposed centrally between a pair of laterally spaced rows of successive sinker loops of the binding chain-stitch threads of the double-knit structure In the case where a plurality of binding chain-stitch threads are used to secure the row of continuous coupling elements, at least one binding tricot-stitch thread is preferably used to interconnect two adjacent ones of the binding chain-stitch threads on the upper surface side of the row of coupling elements. The binding chain-stitch threads thus interconnected by the binding tricot-stitch thread are protected against lateral displacement and can retain throw of coupling elements are retained stably in position against lateral displacement. If three or more binding chain-stitch threads are used, at least two adjacent one of these binding chain-stitch threads, which are located on the upper surface side of the coupling elements adjacent to the coupling heads, should preferably be interconnected by a binding tricot-stitch thread, as shown in FIG. 14. In the latter case, the same advantageous effect can also be attained.

The present invention of the construction described above has various advantages described below. A knit slide fastener of this invention includes a thread knit as binding chain stitches of a double-knit structure and having a series of longitudinally disposed upper needle loops restraining or binding legs of a row of continuous coupling elements, and a series of longitudinally disposed lower needle loops intertwined with knitting threads forming a part of the ground structure of a warp-knit fastener tape. A portion of the fastener tape adapted to support the row of coupling elements is made tight in structure and substantially non-stretchable. The row of coupling elements attached to such tight and non-stretchable element-supporting portion has high dimensional stability. Owing to a series of loops or stitches of the binding chain-stitch thread running on and along the upper surface of the row of coupling elements, the fastener has a good element-covering property and an improved resistance to ironing.

Furthermore, a tricot-stitch thread may be knit as a double-knit structure into the element-supporting portion together with at least two binding chain-stitch threads. The tricot-stitch thread has a series of longitudinally disposed lower needle loops intertwined with knitting threads of the ground structure, and a series of longitudinally disposed upper needle loops intertwined with needle loops of the binding chain-stitch threads on the upper surface of the row of continuous coupling elements to bind the legs of the coupling elements to secure them to the element-supporting portion. With this arrangement, the element-supporting portion is formed into a tight and substantially non-stretchable knit structure which will ensure that the row of coupling elements can be attached firmly to the element-supporting portion with high dimensional stability. Since the two binding chain stitches are interconnected by the tricot-stitches on the upper surface of the row of coupling elements, the binding chain-stitch threads are protected against lateral displacement and the row of coupling elements are retained stably in position against lateral displacement relative to the element-supporting portion. Furthermore, the row of coupling elements, which is covered on its upper surface with the tricot stitches, is highly resistance to ironing and is always held in intimate contact with a surface of the fastener tape to avoid accidental floating. The fastener having two such rows of coupling elements is completely free from accidental chain rupture or splitting and can always retain the necessary functions as a fastener.

A knit slide fastener capable of achieving the same advantageous effects as described above can be also obtained even when the binding tricot-stitch thread on the upper surface of the row of coupling elements and tricot-stitch threads oh the lower surface of the row of coupling elements are replaced by a binding two-needle-stitch thread and two-needle-stitch threads, respectively.

At the element-supporting portion of a fastener tape, at least two binding chain-stitch threads are knit as a double-knit structure and each have a series of lower needle loops intertwined with needle loops of a tricot-stitch thread forming a part of the ground structure, and a series of upper needle loops intertwined with needle loops of a tricot-stitch thread knit on the upper surface of the row of continuous coupling elements. Thus, the row of continuous coupling elements is attached, with upper and lower legs restrained or bound from the above and below, respectively, by two opposed knit structures of tricot stitches respectively overlying and underlying the row of continuous coupling elements. With this arrangement, the knit structure of the element-supporting portion is made tight and substantially non-stretchable. The row of continuous coupling elements attached to such tight and non-stretchable element-supporting portion has a high dimensional stability. Since the two binding chain-stitch threads are interconnected by tricot stitches on the upper surface of the row of coupling elements, the binding chain stitches are held in position against lateral displacement and hence the row of coupling elements are retained stably in position against lateral displacement in the element-supporting portion. Furthermore, the row of coupling elements, which is covered on its upper surface with the tricot stitches, is highly resistant to ironing and is held in intimate contact with a surface of the fastener tape to avoid accidental floating even when the fastener is bent during use. The fastener having two such rows of coupling element is completely free from accidental chain rupture or splitting and can always retain the necessary functions as a fastener. Since the tricot stitches knit on the upper surface of the row of continuous coupling elements have the same knit structure as the tricot stitches knit on the lower surface of the row of continuous coupling elements, the individual knitting needles of a double needle bed are subjected to a uniform knitting load and, hence, is substantially free from a thread-breakage problem, enabling manufacture of the fastener at high production rate.

The foregoing advantageous effects can be obtained even when the tricot stitches disposed on the upper surface of the row of continuous coupling elements for binding the latter and the tricot stitches forming a portion of the ground structure at the element-supporting portion are replaced by two-needle stitches respectively.

Obviously, various minor changes and modifications of the present invention are possible in the light of the above teaching. It is therefore to be understood that within the scope of the appended claims the invention may be practiced otherwise than as specifically described.

What is claimed is:

1. A knit slide fastener including a fastener tape composed of a warp-knit ground structure and having an element-supporting portion along one longitudinal edge thereof, and a row of continuous coupling elements knit into and along said element-supporting portion as said fastener tape is knit, each of said coupling elements having a pair of legs, wherein the improvement comprises:

a thread knit as binding chain stitches of a double-knit structure into said element-supporting portion, said binding chain-stitch thread having a series of longitudinally disposed upper needle loops binding said legs of said row of continuous coupling elements, and a series of longitudinally disposed lower needle loops intertwined with knitting threads of said warp-knit ground structure at said element-supporting portion.

2. A knit slide fastener according to claim 1, further including a thread knit as binding tricot stitches of a double-knit structure into said element-supporting portion together with said binding chain-stitch thread, said tricot-stitch thread having a series of longitudinally disposed upper needle loops binding said legs of said row of continuous coupling elements and intertwined with said upper needle loops of said binding chain-stitch thread, and a series of longitudinally disposed lower needle loops intertwined with said knitting thread of said warp-knit ground structure at said element-supporting portion.

3. A knit slide fastener according to claim 1, further including a thread knit as binding two-needle stitches of a double-knit structure into said element-supporting portion together with said binding chain-stitch thread, said two-needle-stitch thread having a series of longitudinally disposed upper needle loops binding said legs of said row of continuous coupling elements and intertwined with said upper needle loops of said binding chain-stitch thread.

4. A knit slide fastener including a fastener tape composed of a warp-knit ground structure and having an element-supporting portion along one longitudinal edge thereof, and a row of continuous coupling elements knit into and along said element-supporting portion as said fastener tape is knit, each of said coupling elements having a pair of legs, wherein the improvement comprises:

at least two parallel juxtaposed threads knit as binding chain stitches of a double-knit structure into said element-supporting portion, each of said binding chain-stitch threads having a series of upper needle loops and a series of lower needle loops;

at least one thread knit as tricot stitches forming a part of said warp-knit ground structure at said element-supporting portion, said tricot-stitch thread having a plurality of needle loops; and at least one thread knit as binding tricot stitches extending on and along an upper surface of said row of continuous coupling elements, said binding tricot-stitch thread having a plurality of needle loops, wherein said upper needle loops and lower needle loops of said binding chain-stitch threads are intertwined respectively with said needle loops of said binding tricot-stitch thread and said needle loops of said tricot-stitch thread to secure said row of continuous coupling elements to said element-supporting portion, with said legs restrained between said tricot stitches and said binding tricot stitches.

5. A knit slide fastener including a fastener tape composed of a warp-knit ground structure and having an element-supporting portion along one longitudinal edge thereof, and a row of continuous coupling elements knit into and along said element-supporting portion as said fastener tape is knit, each of said coupling elements having a pair of legs, wherein the improvement comprises:

at least two parallel juxtaposed threads knit as binding chain stitches of a double-knit structure into said element-supporting portion, each of said binding chain-stitch threads having a series of upper needle loops and a series of lower needle loops;

at least one thread knit as two-needle stitches forming a part of said warp-knit ground structure at said element-supporting portion, said two-needle-stitch thread having a plurality of needle loops; and at least one thread knit as binding two-needle stitches extending on and along an upper surface of said row of continuous coupling elements, said binding two-needle-stitch thread having a plurality of needle loops, wherein said upper needle loops and lower needle loops of said binding chain-stitch threads are intertwined respectively with said needle loops of said binding two-needle-stitch thread and said needle loops of said two-needle-stitch thread to secure said row of continuous coupling elements to said element-supporting portion, with said legs restrained between said two-needle stitches and said binding two-needle stitches.

* * * * *